US009831618B2

(12) United States Patent
Yamamoto et al.

(10) Patent No.: US 9,831,618 B2
(45) Date of Patent: Nov. 28, 2017

(54) CONNECTION STRUCTURE OF TERMINAL FITTING AND CONNECTION METHOD OF TERMINAL FITTING

(71) Applicant: YAZAKI CORPORATION, Tokyo (JP)

(72) Inventors: Takatatsu Yamamoto, Shizuoka (JP); Yukinari Naganishi, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/392,114

(22) Filed: Dec. 28, 2016

(65) Prior Publication Data

US 2017/0201051 A1 Jul. 13, 2017

(30) Foreign Application Priority Data

Jan. 7, 2016 (JP) ..... 2016-001673

(51) Int. Cl.

| | |
|---|---|
| ***H01R 13/74*** | (2006.01) |
| ***H01R 4/18*** | (2006.01) |
| ***H01R 43/048*** | (2006.01) |
| ***H01R 11/09*** | (2006.01) |
| *H01R 11/12* | (2006.01) |
| *H01R 13/24* | (2006.01) |
| *H01R 11/32* | (2006.01) |

(52) U.S. Cl.

CPC ..... *H01R 13/748* (2013.01); *H01R 4/18* (2013.01); *H01R 4/185* (2013.01); *H01R 4/188* (2013.01); *H01R 11/09* (2013.01); *H01R 43/048* (2013.01); *H01R 11/12* (2013.01); *H01R 11/32* (2013.01); *H01R 13/2428* (2013.01); *Y10S 439/907* (2013.01)

(58) Field of Classification Search

CPC .. H01R 13/2428; H01R 4/185; H01R 43/048; H01R 11/12; H01R 11/32; Y10S 439/907

USPC ..... 439/287, 442, 877, 883, 907

See application file for complete search history.

(56) References Cited

U.S. PATENT DOCUMENTS

| | | | | |
|---|---|---|---|---|
| 4,371,230 A * | 2/1983 | Inoue | ..... | H01R 11/12 439/849 |
| 8,366,499 B2 * | 2/2013 | Shuey | ..... | H01R 11/07 439/883 |
| 2006/0079138 A1 * | 4/2006 | Zhao | ..... | H01R 11/12 439/883 |

FOREIGN PATENT DOCUMENTS

JP 2012-190749 A 10/2012

* cited by examiner

*Primary Examiner* — Abdullah Riyami
*Assistant Examiner* — Justin Kratt
(74) *Attorney, Agent, or Firm* — Kenealy Vaidya LLP

(57) ABSTRACT

A terminal fitting includes a terminal body and terminal connection parts extended from the terminal body. Connection terminals each has a pair of caulking pieces, and each of the connection terminals configured to be connected to an end part of an electric wire. In each of the terminal connection parts, the connection terminal is caulked to the terminal connection part so that the pair of caulking pieces enfold outsides of a pair of caulked pieces provided on the terminal connection part in a state that a bottom face between the pair of caulking pieces faces an opening between ends portions of the pair of caulked pieces. The terminal fitting is connected to the electric wires through the connection terminals.

4 Claims, 12 Drawing Sheets

CONNECTION STRUCTURE OF TERMINAL FITTING AND CONNECTION METHOD OF TERMINAL FITTING

CROSS REFERENCE TO RELATED APPLICATION

This application is based on Japanese Patent Application (No. 2016-001673) filed on Jan. 7, 2016, the contents of which are incorporated herein by reference. Also, all the references cited herein are incorporated as a whole.

BACKGROUND

1. Technical Field

The present invention relates to a connection structure and a connection method of a terminal fitting.

2. Background Art

A connection structure is known in which the connection plates of a plurality of terminal fittings to which a plurality of grounding wires is connected are stacked mutually, a common bolt is inserted into mounting holes provided in the connection plates, and the bolt is fastened to a grounding face (for example, a predetermined position of a vehicle body), whereby the plurality of grounding wires is collectively conducted to the grounding face via the stacked terminal fittings (for example, refer to JP-A-2012-190749).

However, in the case of the above-mentioned structure in which the terminal fittings are stacked and fastened with the bolt, the terminal fittings connected to the respective grounding wires are stacked and fastened with the bolt, the weight of the terminal fittings increases as the number of the grounding wires increases. Furthermore, the thickness of the stacked terminal fittings increases as the number of the grounding wires increases, whereby a large space for accommodating the terminal fittings is required to be secured above the grounding face. Moreover, since fastening work is performed after bolt/nut length adjustment associated with the stacking of the terminal fittings has been completed, the work takes time.

Also, in order that a plurality of grounding wires is collectively conducted and connected, it is conceivable to use a joint connector being configured such that a plurality of connection terminals connected to the grounding wires is inserted into the housing thereof accommodating joint terminals, whereby the plurality of grounding wires is collectively conducted and connected by the joint terminals while the plurality of connection terminals is held inside the housing. However, in the case of this joint connector, since holding mechanisms (for example, engaging lances) for holding the connection terminals are required to be provided inside the housing, it is difficult to make the housing small in size. Furthermore, since the housing equipped with the holding mechanisms is required, it is inevitable that the cost of the joint connector will increase.

Still further, in the case of the fastening using the bolt, the bolt may become loose, and the connection reliability after the connection may be degraded in some cases. If the connection terminals are crimped and fastened to the terminal fittings to solve this problem, a strong connection structure is obtained. However, the relative postures of the connection terminals become unstable when the connection terminals are crimped with a crimping machine and there is a danger of causing fluctuations in crimping strength.

SUMMARY

The present invention has been made in consideration of the above-mentioned circumstances, and an object of the present invention is to provide a connection structure and a connection method of a terminal fitting capable of collectively conducting and connecting a plurality of electric wires at high connection reliability while suppressing weight and saving space.

To attain the above-mentioned object, there is provided a connection structure of a terminal fitting, comprising:

a terminal fitting comprising:

a terminal body; and a plurality of terminal connection parts extended from the terminal body; and connection terminals each having a pair of caulking pieces, and each of the connection terminals configured to be connected to an end part of an electric wire, wherein in each of the plurality of terminal connection parts of the terminal fitting, the connection terminal is caulked to the terminal connection part so that the pair of caulking pieces of the connection terminal enfold outsides of a pair of caulked pieces provided on the terminal connection part in a state that a bottom face between the pair of caulking pieces faces an opening between ends portions of the pair of caulked pieces: or the connection terminal is caulked to the terminal connection part so that the pair of caulking pieces of the connection terminal enfold outsides of both side sections of the terminal connection part and end portions of the pair of caulking pieces are folded back inward and made contact with each other; and wherein the terminal fitting is connected to the electric wires through the connection terminals.

Still further, to attain the above-mentioned object, there is provided a connection method of a terminal fitting having a terminal body and a plurality of terminal connection parts extended from the terminal body, for performing connection by caulking a pair of caulking pieces of a connection terminal connected to an end part of an electric wire to a pair of caulked pieces provided on the terminal connection part, in each of the plurality of terminal connection parts of the terminal fitting, the connection method comprising:

forming a holding space into which the pair of caulked pieces of the terminal connection part can be inserted in the connection terminal by the caulking pieces;

holding the terminal connection part in the connection terminal by inserting the terminal connection part into the holding space so that end portions of the pair of caulked pieces are directed in an opposite direction with respect to end portions of the pair of caulking pieces; and caulking the pair of caulked pieces in the holding space by crushing the pair of caulking pieces.

The present invention can provide a connection structure and a connection method of a terminal fitting capable of collectively conducting and connecting a plurality of electric wires at high connection reliability while suppressing weight and saving space.

The present invention has been described above briefly. Moreover, the details of the present invention will be further clarified by reading the descriptions of the modes (hereafter referred to as "embodiments") for embodying the invention to be described below referring to the accompanying drawings.

BRIEF DESCRIPTION OF THE DRAWINGS

FIG. 1A is a perspective view showing the terminal fitting to which grounding wires are connected, and FIG. 1B is a plan view showing the terminal fitting to which the grounding wires are connected.

FIG. 6A is a cross-sectional view taken on line B-B in FIG. 5; FIG. 6B is a cross-sectional view taken on line C-C in FIG. 5; and FIG. 6C is a cross-sectional view taken on line D-D in FIG. 5.

FIG. 8A is a cross-sectional view taken on line A-A in FIG. 1B before the fastening of the caulking pieces; FIG. 8B is a cross-sectional view taken on line A-A in FIG. 1B during the fastening of the caulking pieces; and FIG. 8C is a cross-sectional view taken on line A-A in FIG. 1B after the fastening of the caulking pieces.

FIG. 9A is a cross-sectional view before the fastening of the caulking pieces; and FIG. 9B is a cross-sectional view after the fastening of the caulking pieces.

FIG. 10A is a perspective view showing the terminal fitting to which the grounding wires are connected; and FIG. 10B is a plan view showing the terminal fitting to which the grounding wires are connected.

FIG. 11A is a perspective view showing the terminal fitting and the connection terminal; and FIG. 11B is a plan view showing the terminal fitting and the connection terminal.

FIG. 12A is a front view, FIG. 12B is a side view; and FIG. 12C is a cross-sectional view.

FIG. 13A is a cross-sectional view taken on line E-E in FIG. 10B before the fastening of the caulking pieces; FIG. 13B is a cross-sectional view taken on line E-E in FIG. 10B during the fastening of the caulking pieces; and FIG. 13C is a cross-sectional view taken on line E-E in FIG. 10B after the fastening of the caulking pieces.

DETAILED DESCRIPTION OF THE EXEMPLARY EMBODIMENTS

Embodiments according to the present invention will be described below referring to the accompanying drawings.

First Embodiment

First, a connection structure and a connection method of a terminal fitting according to a first embodiment of the present invention will be described.

Figure 1A:
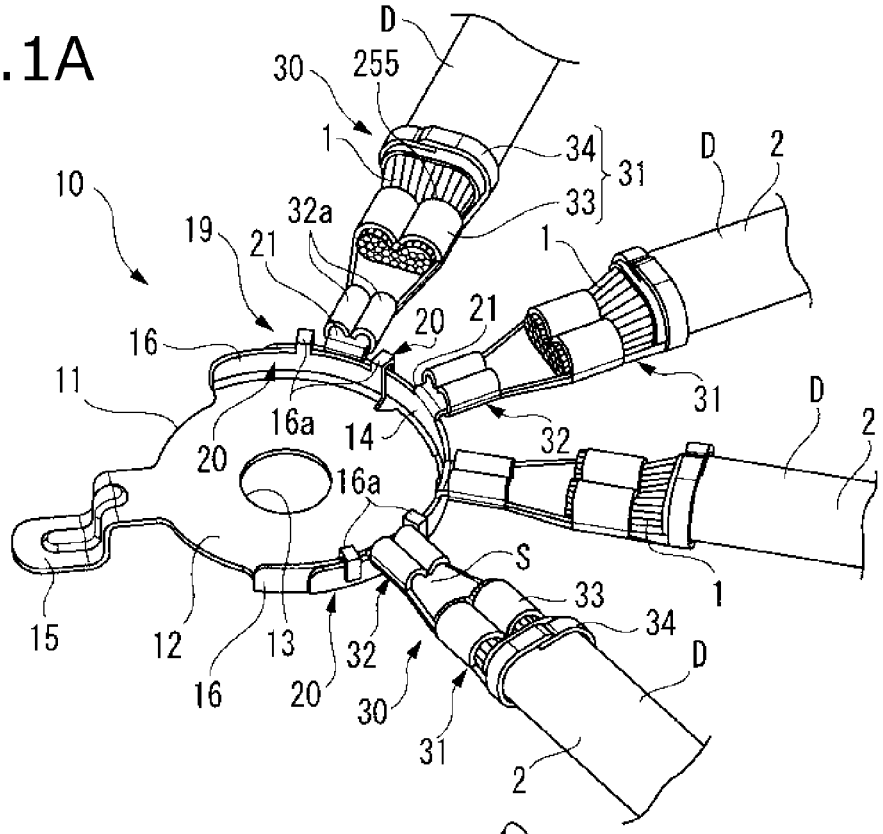
FIGS. 1A and 1B are views illustrating a connection structure of a terminal fitting according to a first embodiment of the present invention.
Figure 1B:
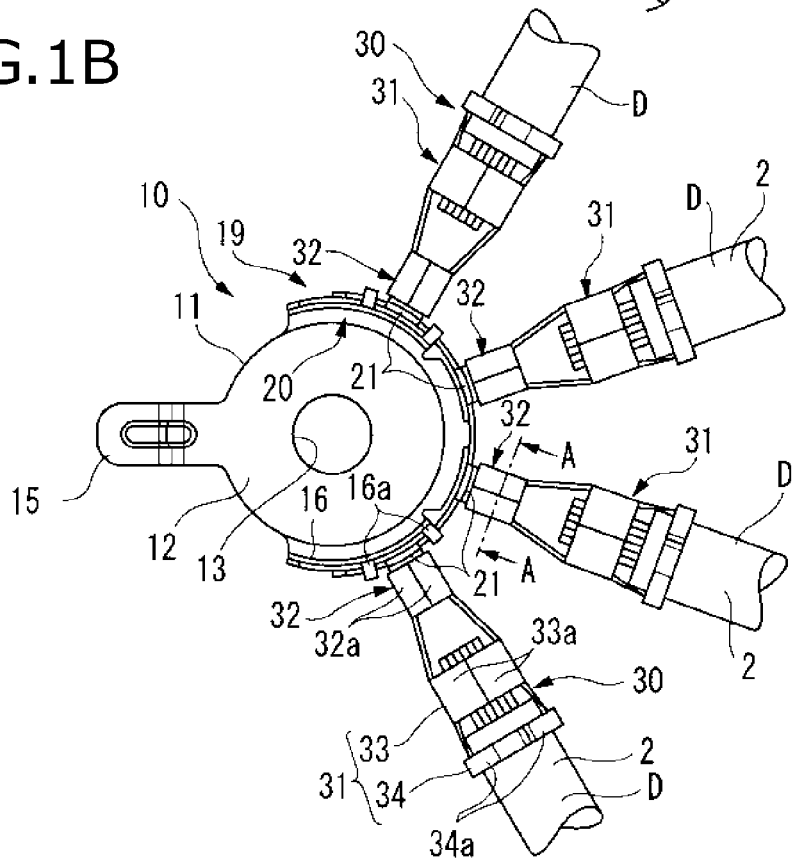

FIGS. 1A and 1B are views illustrating the connection structure of the terminal fitting according to the first embodiment; FIG. 1A is a perspective view showing a terminal fitting 10 to which grounding wires D are connected, and FIG. 1B is a plan view showing the terminal fitting 10 to which the grounding wires D are connected.

As shown in FIGS. 1A and 1B, in the connection structure of the terminal fitting according to the first embodiment, the terminal connection parts 21 of the terminal fitting 10 are connected to connection terminals 30. The terminal fitting 10 is conducted and connected to a grounding face, such as a vehicle body. The connection terminals 30 connected to the terminal fitting 10 are provided at the end sections of the grounding wires (electric wires) D of vehicle-mounted circuits (auxiliary devices). The grounding wire D has a conductor section 1 and an outer coating 2 for covering this conductor section 1, and the conductor section 1 is exposed from the outer coating 2 at the end section that is connected to the connection terminal 30. The conductor section 1 of the grounding wire D is conducted to the connection terminal 30. Hence, the grounding wires D of the vehicle-mounted circuits are conducted to the grounding face, such as a vehicle body, via the terminal fitting 10. The grounding wire D having a size of 8 $mm^2$, for example, is connected to the connection terminal 30.

Figure 2:
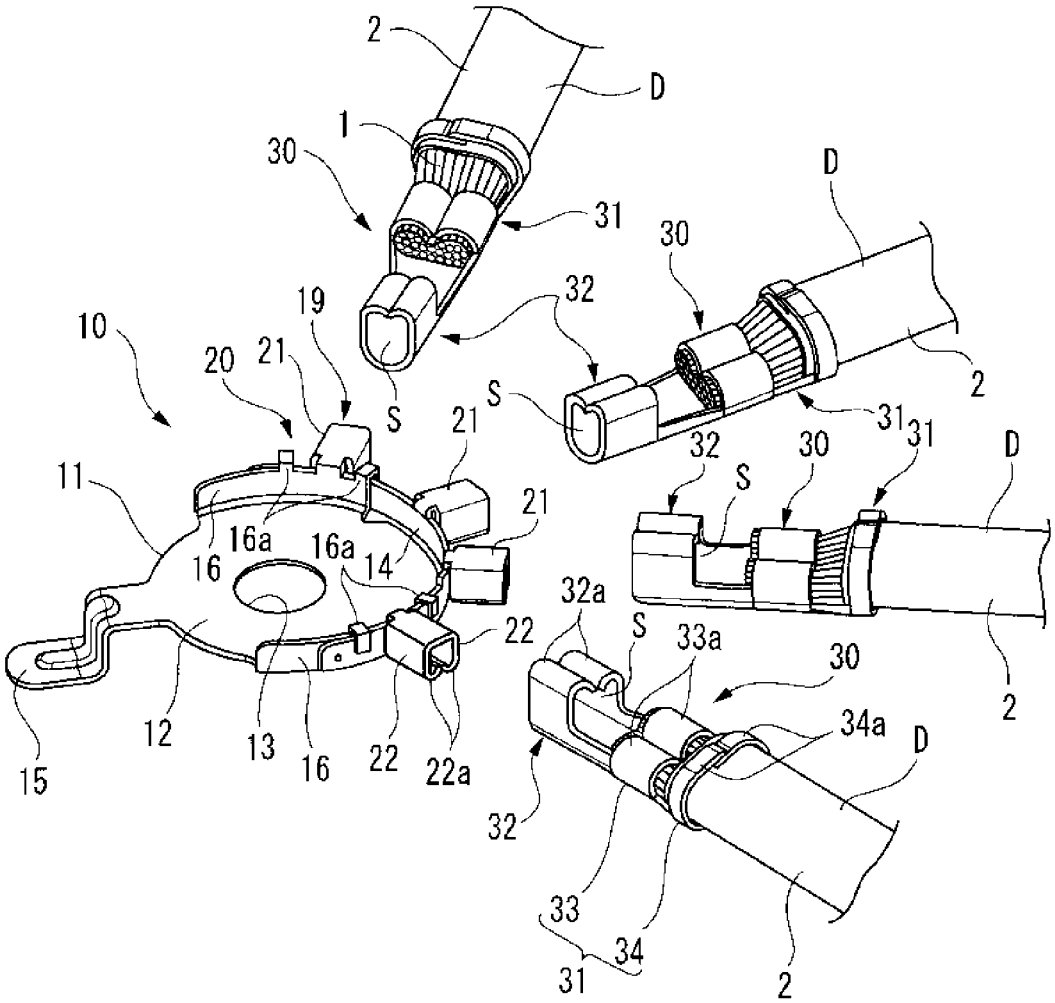
FIG. 2 is a perspective view showing the terminal fitting and connection terminals, illustrating the connection structure of the terminal fitting according to the first embodiment.
Figure 3:
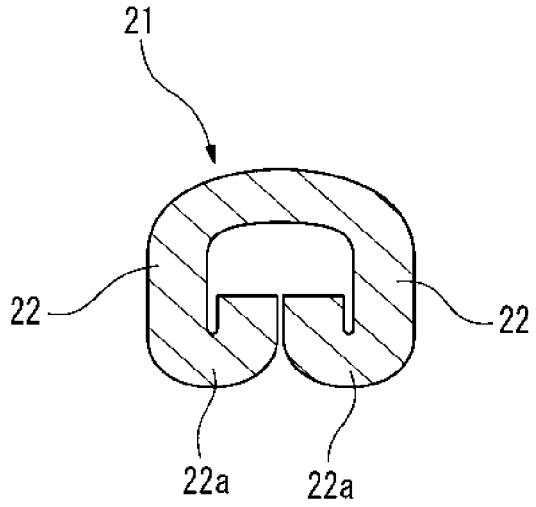
FIG. 3 is a cross-sectional view showing a terminal connection part of the terminal fitting according to the first embodiment.

FIG. 2 is a perspective view showing the terminal fitting 10 and the connection terminals 30, illustrating the connection structure of the terminal fitting according to the first embodiment. FIG. 3 is a cross-sectional view showing the terminal connection part 21 of the terminal fitting 10.

As shown in FIG. 2, the terminal fitting 10 has a terminal body 11 and a wire connection section body 19 having the plurality of terminal connection parts 21. The terminal fitting 10 is a press-formed product made of a metal plate having conductivity. The terminal body 11 has a fixing plate section 12 having a circular shape in a plan view. A circular mounting hole 13 is formed at the center of this fixing plate section 12. The terminal body 11 is fixed to the grounding face, such as a vehicle body, with a bolt (not shown) that is inserted into the mounting hole 13 of the fixing plate section 12. The mounting hole 13, however, is not required to be provided at the center of the fixing plate section 12, but may be provided eccentrically.

A rotation-stopping piece 15 is formed in part of the fixing plate section 12. The rotation-stopping piece 15 is a bent section to be engaged with a step or a hole provided around the grounding face to which the terminal body 11 is fastened with the bolt. The rotation of the terminal fitting 10 with respect to the grounding face is regulated by the engagement of the rotation-stopping piece 15 with the step or the hole provided around the grounding face.

Two support wall sections 16 having a circular arc shape in a plan view are formed along the peripheral edge of the fixing plate section 12. These support wall sections 16 are provided upright on the upper face side, that is, one of the face sides, of the fixing plate section 12. Furthermore, in the wire connection section body 19, a connection plate section 14 having a circular arc shape in a plan view is provided in a nearly half circumferential range of the peripheral edge of the fixing plate section 12. The connection plate section 14 is provided upright on the upper face side, that is, one of the face sides, of the fixing plate section 12. The connection plate section 14 is disposed along the outer circumferential faces of the support wall sections 16.

A plurality of engaging pieces 16*a* is formed at the upper edge of the support wall section 16. These engaging pieces 16*a* are folded back to the outer face side of the connection plate section 14, whereby both the end sides of the connection plate section 14 are engaged with the engaging pieces 16*a* and the connection plate section 14 is supported by the support wall sections 16.

Hence, in the terminal fitting 10, the portions of the connection plate section 14, engaged with the engaging pieces 16 of the support wall sections 16, are used as connection sections 20. That is to say, the terminal fitting 10 has a plurality of connection sections 20, and the terminal body 11 and the wire connection section body 19 are connected to each other with the plurality of connection sections 20.

The terminal connection parts 21 are integrated with the connection plate section 14 of the terminal body 11. The terminal connection parts 21 being plural in number are provided at the upper edge portions of the connection plate section 14. More specifically, the terminal connection parts 21 being four in number are formed on the connection plate section 14. These terminal connection parts 21 are extended in the same plane so as to protrude radially from the peripheral edge positions of the fixing plate section 12.

As shown in FIG. 3, each terminal connection part 21 has engaging walls 22 serving as caulked pieces and protruding to the lower face side, that is, one of the face sides, of the terminal connection part 21 on both the side sections thereof. Hence, each terminal connection part 21 is formed into a reversed U-shape in a front view. In addition, each of the engaging walls 22 has an engaging piece 22*a* being curved inward into a circular arc shape and folded back at the lower end section thereof.

Figure 4:
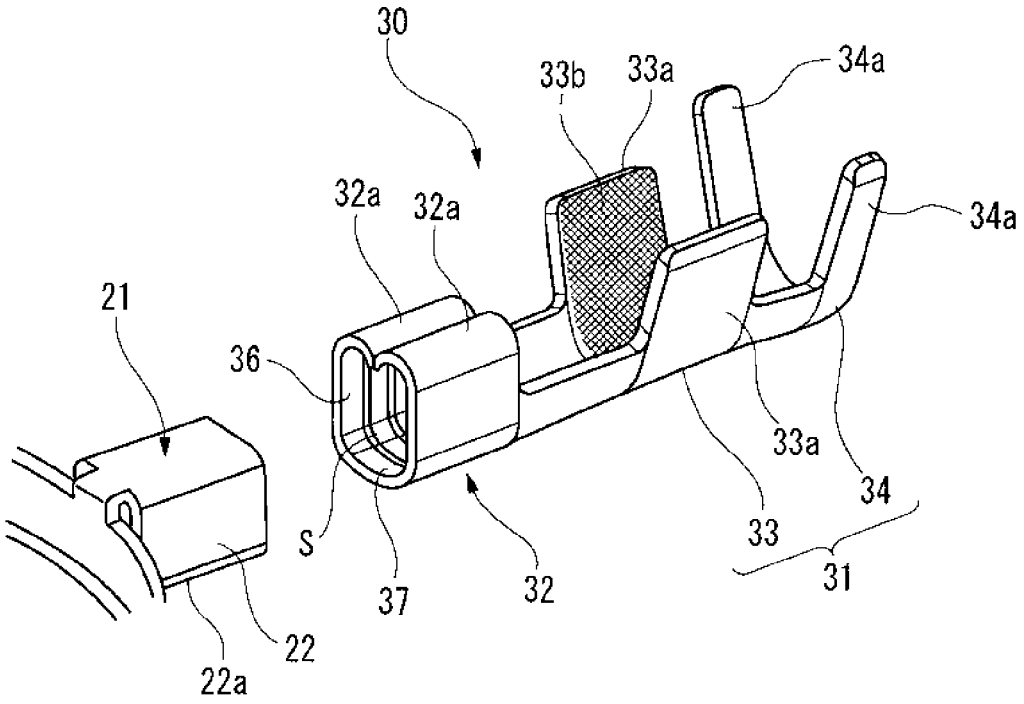
FIG. 4 is a perspective view showing the terminal connection part and the connection terminal.
Figure 5:
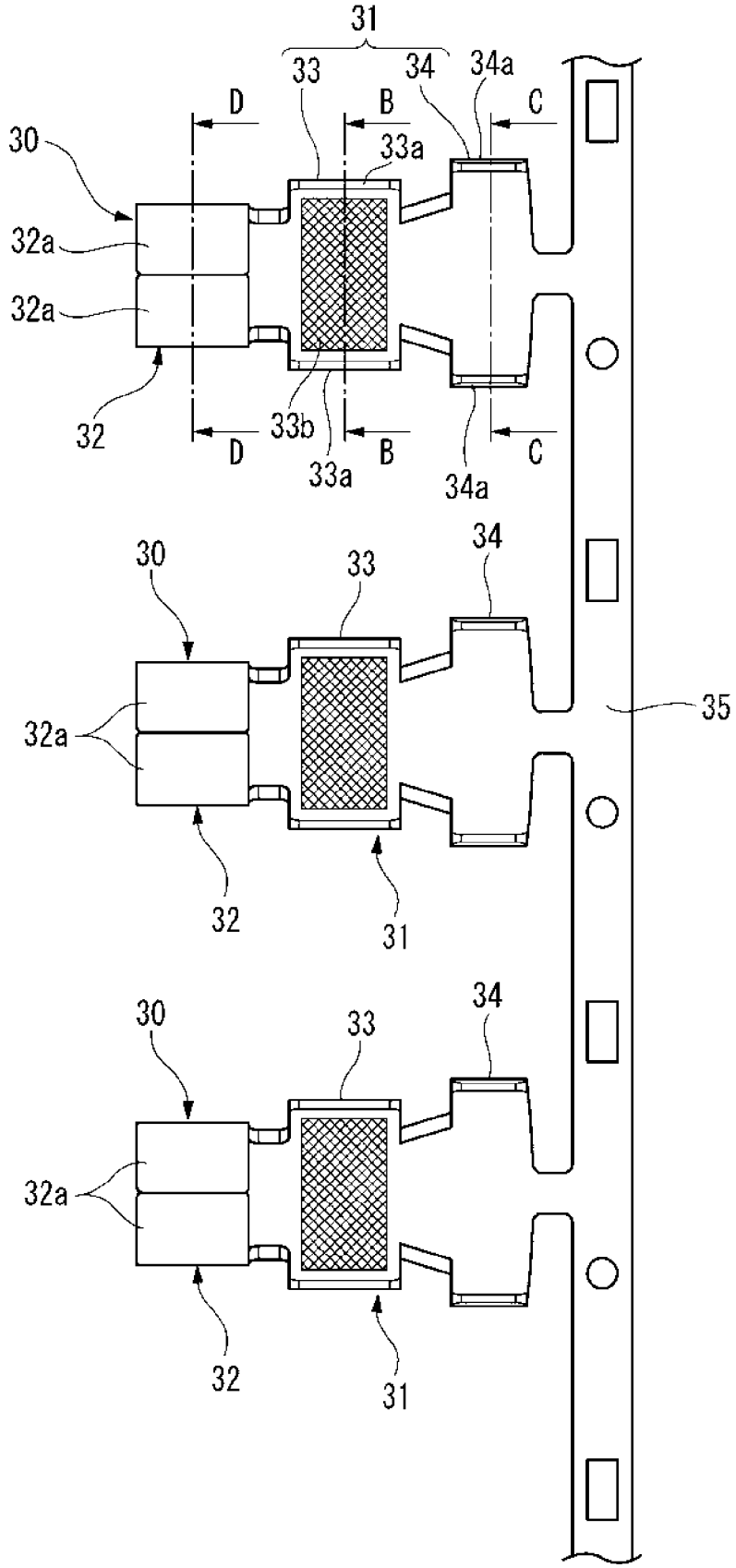
FIG. 5 is a plan view showing the connection terminals connected to a carrier.
Figure 6A:
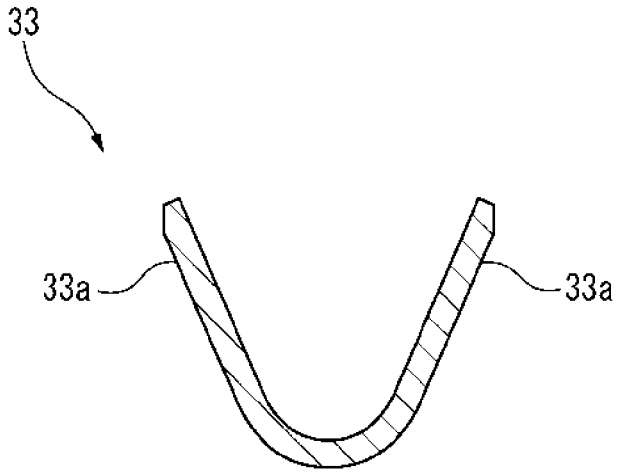
FIGS. 6A to 6C are views illustrating the connection terminal.
Figure 6B:
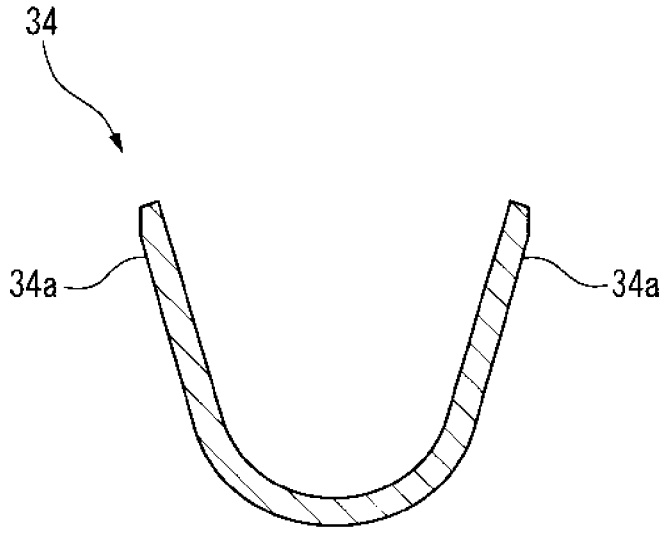
Figure 6C:
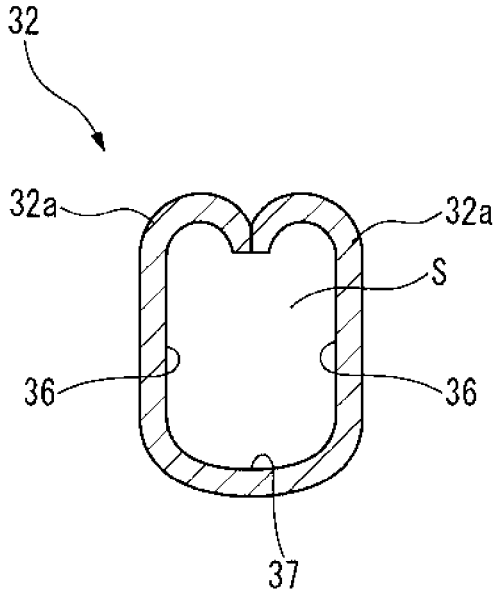

FIG. 4 is a perspective view showing the terminal connection part 21 and the connection terminal 30. FIG. 5 is a plan view showing the connection terminals 30 connected to a carrier. FIGS. 6A to 6C are views illustrating the connection terminal 30; FIG. 6A is a cross-sectional view taken on line B-B in FIG. 5, FIG. 6B is a cross-sectional view taken on line C-C in FIG. 5, and FIG. 6C is a cross-sectional view taken on line D-D in FIG. 5.

As shown in FIG. 4, the connection terminal 30 has a wire connection section 31 and a fastening connection section 32. The grounding wire D is connected to the wire connection section 31. The connection terminal 30 provided for the grounding wire D is a press-formed product made of a metal plate having conductivity. The fastening connection section 32 is caulked and fastened to the terminal connection part 21 of the terminal fitting 10.

As shown in FIG. 5, the connection terminals 30, on the sides of the wire connection sections 31 thereof being connected to a band-shaped carrier 35, are supplied and then separated from the carrier 35 and used. The wire connection section 31 has a conductor caulking section 33 and a coating caulking section 34.

As shown in FIGS. 4 and 6A, the conductor caulking section 33 is formed into a U-shape having a pair of conductor caulking pieces 33*a*. The conductor section 1 of the grounding wire D is caulked and fixed to the conductor caulking section 33 by caulking the conductor caulking pieces 33*a*. Hence, the conductor section 1 of the grounding wire D is conducted to the connection terminal 30. Furthermore, a rough face section (serration) 33*b* being processed so as to be roughened is provided on the inner face of the conductor caulking section 33. However, the rough face section 33*b* is not limited to have the shape shown in the figure. With this configuration, the conductor section 1 of the grounding wire D caulked to the conductor caulking section 33 is securely conducted to the connection terminal 30.

As shown in FIGS. 4 and 6B, the coating caulking section 34 is formed into a U-shape having a pair of coating caulking pieces 34*a*. The tip end portion of the outer coating 2 of the grounding wire D is caulked and fixed to the coating caulking section 34 by caulking the coating caulking pieces 34*a*.

For the connection of the grounding wire D to the connection terminal 30, the outer coating 2 is removed to expose the conductor section 1 at the end section of the grounding wire D. Furthermore, the end section of the grounding wire D is placed on the wire connection section 31 of the connection terminal 30, the conductor caulking section 33 is caulked, and the coating caulking section 34 is caulked, and then the connection terminal 30 is cut off from the carrier 35. As a result, the grounding wire D is conducted and connected to the connection terminal 30.

As shown in FIGS. 4 and 6C, the fastening connection section 32 of the connection terminal 30 has a pair of caulking pieces 32*a*. The caulking pieces 32*a* stand upright upward from the bottom section of the fastening connection section 32. Furthermore, the upper end sections of the caulking pieces 32*a* are curved inward into a circular arc shape and folded back.

With this configuration, a holding space S enclosed with the caulking pieces 32*a* is formed in the fastening connection section 32 of the connection terminal 30. Both the side faces of the holding space S are nearly vertical faces formed by the caulking pieces 32*a* standing upright upward, and both the side faces are used as rotation regulating faces 36. Moreover, the bottom face 37 forming the holding space S is curved so as to slightly expand downward.

The holding space S of the fastening connection section 32 is formed so as to be slightly larger than the external size of the terminal connection part 21 in a front view. Hence, the terminal connection part 21 can be inserted into the holding space S (see FIG. 8A). Also, in a state in which the terminal connection part 21 is inserted in the holding space S, the terminal connection part 21 makes contact with the rotation regulating faces 36 formed of both the side faces forming the holding space S, whereby the rotation of the terminal connection part 21 around the axial line along the insertion direction of the terminal connection part 21 to the holding space S is regulated.

Next, a case in which the connection terminal 30 is caulked and fastened to the terminal connection part 21 of the terminal fitting 10 will be described.

Figure 7:
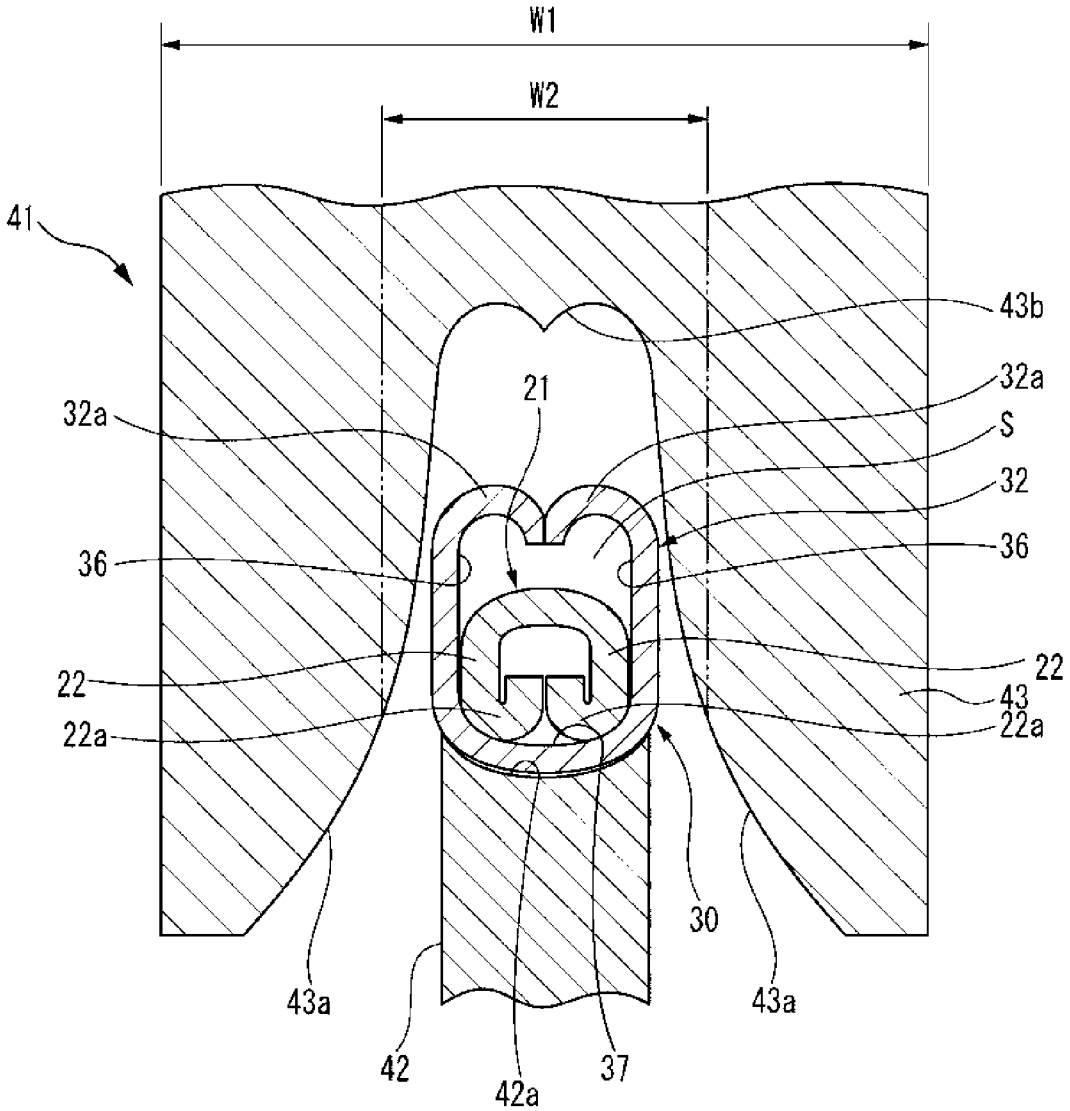
FIG. 7 is a schematic cross-sectional view showing a crimping machine in which the connection terminal and the terminal connection part are set.
Figure 8A:
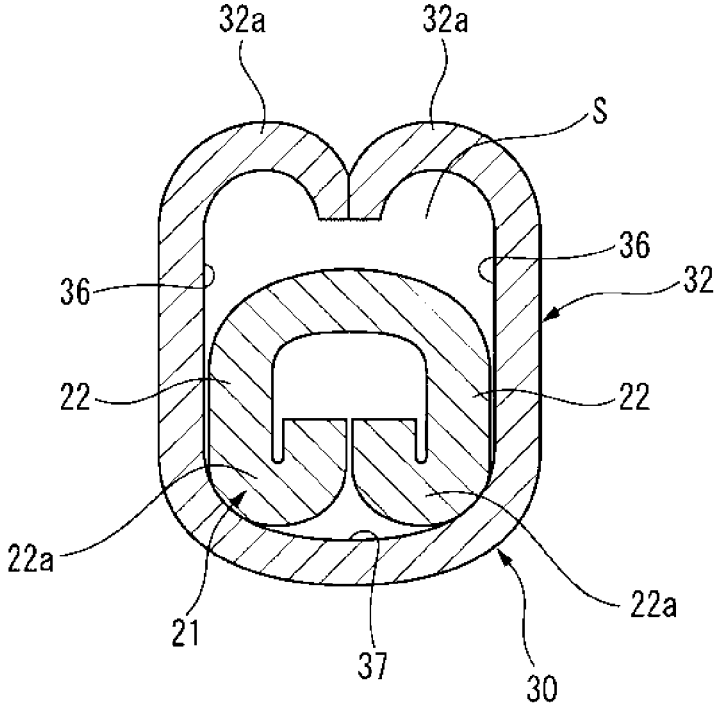
FIGS. 8A to 8C are views showing states in which the caulking pieces of a fastening connection section are fastened to the terminal connection part of the terminal fitting.
Figure 8B:
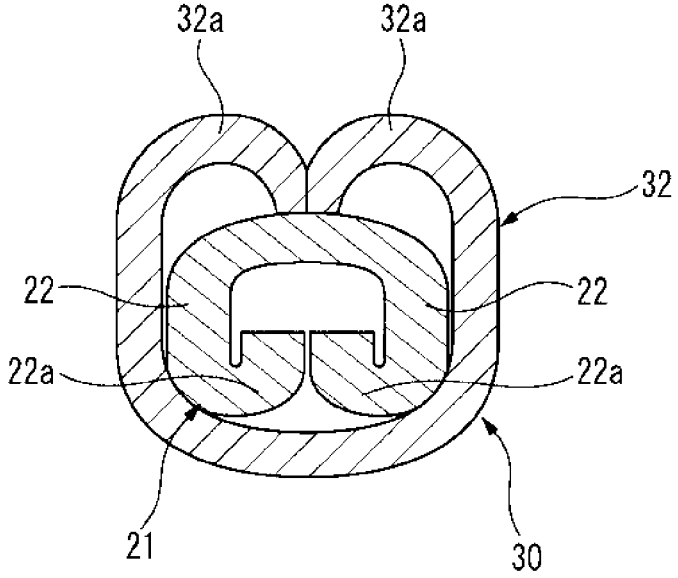
Figure 8C:
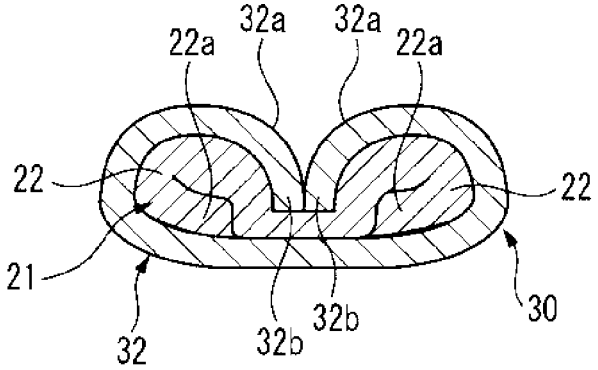

FIG. 7 is a schematic cross-sectional view showing a crimping machine 41 in which the connection terminal 30 and the terminal connection part 21 are set. FIGS. 8A to 8C are views showing states in which the caulking pieces 32*a* of the fastening connection section 32 are fastened to the terminal connection part 21 of the terminal fitting 10; FIG. 8A is a cross-sectional view taken on line A-A in FIG. 1B before the fastening of the caulking pieces 32*a*, FIG. 8B is a cross-sectional view taken on line A-A in FIG. 1B during the fastening of the caulking pieces 32*a*, and FIG. 8C is a cross-sectional view taken on line A-A in FIG. 1B after the fastening of the caulking pieces 32*a*.

As shown in FIG. 7, the crimping machine 41, for crimping the connection terminal 30 to the terminal connection part 21 so as to caulk and fasten the terminal, has an anvil 42 and a crimper 43 that is configured so as to be able to approach the anvil 42 and to be separated therefrom. The upper face of the anvil 42 is used as a mounting face 42*a*, and the connection terminal 30 is mounted on the mounting face 42*a*. The mounting face 42*a* is formed into a circular arc shape slightly recessed downward. Hence, the connection terminal 30 mounted on the mounting face 42*a* is disposed on the anvil 42. The crimper 43 is formed into a concave shape having guide faces 43*a* gradually expanding toward the anvil 42. At the upper section of the concave portion, the crimper 43 has pressing faces 43*b* for respectively pressing the caulking pieces 32*a* while guiding them inward.

(Temporary Fixing Step)

As shown in FIG. 8A, first, the terminal connection part 21 is temporarily fixed to the connection terminal 30. More specifically, the terminal connection part 21 is inserted into the holding space S of the connection terminal 30. At this time, the terminal connection part 21 is inserted into the holding space S such that the ends portions of the pair of engaging walls 22 are directed to the opposite side of the ends portions of the pair of caulking pieces 32*a*. When the terminal connection part 21 is inserted into the holding space S as described above, both the side faces of the terminal connection part 21 make contact with the rotation regulating faces 36 formed of both the side faces of the holding space S, whereby the terminal connection part 21 is held by the fastening connection section 32 of the connection terminal 30 in a state in which the rotation thereof around the axial line along the insertion direction is regulated. As a result, the terminal connection part 21 is maintained in a predetermined posture with respect to the connection terminal 30.

In addition, since the bottom face 37 of the holding space S is curved downward into a concave shape, the terminal connection part 21 inserted into the holding space S has a stable posture on the bottom face 37. In particular, since the engaging pieces 22*a* of the terminal connection part 21 are curved inward into a circular arc shape and folded back, the terminal connection part 21 becomes stable on the bottom face 37 of the holding space S.

(Mounting Step)

As shown in FIG. 7, the connection terminal 30 to which the terminal connection part 21 is temporarily fixed is mounted on the mounting face 42*a* of the anvil 42. Also in this state, since the terminal connection part 21 has been inserted into the holding space S, the rotation thereof around the axial line along the insertion direction is regulated, whereby the terminal connection part 21 is maintained in the predetermined posture with respect to the connection terminal 30.

(Fastening Step)

The crimping machine 41 is operated to start crimping, and the crimper 43 of the crimping machine 41 is lowered. The fastening connection section 32 is then guided to the concave portion by the guide faces 43*a* of the crimper 43. Also at this time, the terminal connection part 21 is maintained in the predetermined posture with respect to the connection terminal 30 inside the holding space S. After that, the pressing faces 43*b* of the crimper 43 make contact with the upper section (the base sections of the caulking pieces 32*a*) of the fastening connection section 32, whereby the caulking pieces 32*a* are crushed by the crimper 43 and caulking is started.

As shown in FIG. 8B, the caulking pieces 32*a* then enfold the outsides of the pair of engaging walls 22 formed on the terminal connection part 21 from the sides of the ends portions (the lower sides) thereof. After that, the caulking pieces 32*a* are caulked so as to enfold the engaging walls 22 of the terminal connection part 21 and the engaging pieces 22*a* provided at the lower ends thereof from the outside.

As a result, the pair of engaging walls 22 having the engaging pieces 22*a* protruding downward is rounded and accommodated inside the caulking pieces 32*a* without clearance, and the inside of the fastening connection section 32 is in a state of being filled with the terminal connection part 21 as shown in FIG. 8C. Consequently, the fastening connection section 32 is strongly fastened to the terminal connection part 21 with high contact pressure, and the terminal fitting 10 is securely conducted to the connection terminal 30.

Since the pair of caulking pieces 32*a* is caulked so as to enfold the outsides of the pair of engaging walls 22 from the sides of the ends portions thereof, the strength of the connection can be enhanced while residual stress in the opening direction of the crimping section is lowered. That is to say, since the ends portions of the engaging walls 22 are positioned on the bottom section side of the fastening connection section 32, the residual stress in the opening direction of the engaging walls 22 is applied to the base section sides of the caulking pieces 32*a* but is hardly applied to the opening end sides of the caulking pieces 32*a*. As a result, in comparison with a crimping section that is caulked such that the ends portions of the engaging walls are positioned on the sides of the ends portions of the fastening connection section, in the case of the crimping section in the connection structure of the terminal fitting according to the first embodiment, the residual stress in the opening direction lowers and the strength of the connection is enhanced, whereby the reliability of the connection from the connection terminal 30 to the terminal connection part 21 is improved.

Furthermore, since the ends portions 32*b* of the pair of caulking pieces 32*a* are caulked so as to be folded back inward and make contact with each other, residual stress in the direction in which the ends portions 32*b* make contact with each other is exerted, whereby the crimping section is suppressed from being opened and the connection strength can be enhanced further.

When the respective terminal connection parts 21 of the terminal fitting 10 are fastened and connected to the connection terminals 30 by the above-mentioned step, the plurality of grounding wires D is collectively conducted to the terminal fitting 10. The terminal fitting 10 is then fixed to the grounding face of the vehicle with the bolt, whereby the plurality of grounding wires D is grounded.

As described above, with the connection structure of the terminal fitting according to the first embodiment, the terminal connection part 21 is held in the connection terminal 30 by inserting the terminal connection part 21 into the holding space S enclosed with the caulking pieces 32*a* of the connection terminal 30, whereby the caulking pieces 32*a* can be caulked and fastened in a state in which the terminal connection part 21 is held in the connection terminal 30. Hence, the terminal connection part 21 can be maintained in a stable posture during the caulking and fastening, whereby high connection reliability can be obtained while fluctuations in crimping strength are suppressed.

In addition, with the connection method of the terminal fitting according to the first embodiment, the terminal connection part 21 is inserted and held in the holding space S preliminarily formed in the connection terminal 30, and the caulking pieces 32*a* that are crushed and caulked so as to enclose the outsides of both the side sections of the terminal connection part 21 inside the holding space S are used to fasten the terminal connection part 21, whereby the fastening work can be performed in a state in which the posture of the terminal connection part 21 with respect to the connection terminal 30 is maintained stable. Hence, the workability of the fastening work can be improved, and high connection reliability can be obtained while fluctuations in crimping strength are suppressed. Furthermore, since the holding space S is preliminarily formed in the connection terminal 30, the width of the connection terminal 30 can be suppressed in comparison with the width of a connection terminal in which the caulking pieces 32*a* thereof are formed into a U-shape expanding upward. Hence, components, such as the crimper 43, to be used when the crimping machine 41 performs fastening can be downsized and the working space can be reduced. For example, as shown in FIG. 7, the guide faces 43*a* can be made small in comparison with the size in a case in which the caulking pieces formed into a U-shape expanding upward are caulked, whereby the width of the crimper 43 can be remarkably reduced from W1 to W2.

Moreover, the terminal connection part 21 inserted in the holding space S is held in the connection terminal 30 in a state in which the rotation thereof around the axial line along the insertion direction is regulated by the rotation regulating faces 36 formed of both the side faces of the holding space S. Hence, the terminal connection part 21 can be maintained in a more stable posture with respect to the connection terminal 30, whereby the accuracy of the caulking and fastening work can be enhanced.

Also, the terminal connection part 21 inserted in the holding space S is held in a stable state on the bottom face 37 of the holding space S that is curved downward. Hence, the terminal connection part 21 can be maintained in a more stable posture with respect to the connection terminal 30, and the accuracy of the fastening work can be enhanced.

Still further, with the first embodiment, since the plurality of grounding wires D can be collectively conducted and connected to the terminal fitting 10 by connecting the plurality of grounding wires D to the terminal fitting 10, the terminal fitting 10 is not required to be stacked in comparison with the conventional structure in which the terminal fittings thereof connected to the respective grounding wires are stacked, fastened and conducted, whereby, even if the number of the grounding wires D increases, the increase in the weight of the terminal fitting 10 can be suppressed. Furthermore, since the terminal fitting 10 is not required to be stacked, even if the number of the grounding wires D to be conducted and connected increases, the thickness of the terminal fitting 10 does not increase, whereby space saving is attained. Moreover, since the connection terminals 30 are caulked and fastened to the terminal connection parts 21 of the terminal fitting 10, the need for special holding mechanisms for holding the connection terminals 30 can be eliminated. Consequently, the terminal fitting 10 can be made small in size and low in cost in comparison with the joint connector that requires such holding mechanisms for holding the terminals inside the housing thereof.

In addition, since the structure of the terminal fitting 10 is configured such that the connection terminals 30 separated from the terminal fitting 10 are fastened and connected to the terminal fitting 10, the connection terminals 30 to which the grounding wires D having different sizes are connected can be fastened and conducted to the terminal connection parts 21. In other words, the grounding wires D having various sizes can be connected without changing the connection configuration between the terminal connection part 21 of the terminal fitting 10 and the fastening connection section 32 of the connection terminal 30. Furthermore, the increase/decrease in the number of the grounding wires D to be conducted can be easily dealt with by preparing the terminal fittings 10 being different in the number of the terminal connection parts 21.

For example, also in a terminal fitting integrated with a plurality of connection sections being connectable to a plurality of grounding wires D, the plurality of grounding wires D can be conducted collectively. However, in this kind of terminal fitting, a plurality of such terminal fittings must be prepared depending on the number of the grounding wires D to be connected. Besides, depending on the change in the size of the grounding wire D, a terminal fitting having a connection section suited for the grounding wire D must be prepared.

On the other hand, with the connection structure of the terminal fitting according to the first embodiment, the terminal fitting 10 having minimum necessary variation can be used to deal with the changes in the number and size of the grounding wires D to be conducted.

In addition, since the structure of the terminal fitting 10 is configured such that the connection terminals 30 are caulked and fastened to the plurality of terminal connection parts 21 of the terminal fitting 10, the connection terminals 30 can be fastened to the terminal connection parts 21 as necessary, whereby the number of the grounding wires D to be conducted collectively can be increased/decreased easily within the range of the number of the terminal connection parts 21.

Furthermore, the engaging walls 22 to be engaged with the caulking pieces 32*a* are formed on both the side sections of the terminal connection part 21. Hence, the caulking pieces 32*a* of the connection terminal 30 are engaged with the engaging walls 22 of the terminal connection part 21 by caulking the caulking pieces 32*a* to the terminal connection part 21. As a result, the caulking pieces 32*a* can be securely crimped to the terminal connection part 21, whereby the strength of the connection from the connection terminal 30 to the terminal connection part 21 can be enhanced further, and the electrical resistance at the connection position can be made stable and the electrical connection can be performed satisfactorily.

Moreover, since the pair of caulking pieces 32*a* is caulked so as to enfold the outsides of the pair of engaging walls 22 from the sides of the ends portions thereof, the strength of the connection can be enhanced while residual stress in the opening direction of the crimping section is lowered, whereby the reliability of the connection from the connection terminal 30 to the terminal connection part 21 is improved.

Additionally, the terminal connection parts 21 according to the first embodiment are extended radially in the same plane. Hence, numerous terminal connection parts 21 can be provided while the occupancy area of the terminal fitting 10 is suppressed as small as possible, whereby numerous grounding wires D can be connected collectively.

Also, when the connection structure of the terminal fitting according to the first embodiment is disassembled, the wire connection section body 19 connected to the terminal body 11 using the connection sections 20 can be separated, whereby the plurality of grounding wires D can be collectively separated from the terminal body 11 and excellent recyclability can be obtained.

Still further, in the case that the connection joint strength is adjusted depending on wiring states, for example, the diameters of the grounding wires D and the number of the connections, by adjusting the engaging force exerted by the engaging pieces 16*a* of the connection sections 20 for connecting the terminal body 11 to the wire connection section body 19, excellent separation performance at the time of the disassembling can be securely obtained while the connection strength at the time of the wiring is securely obtained, whereby both durability and recyclability can be attained. For example, the joint strength between the terminal body 11 and the wire connection section body 19 can be adjusted from the strength required for the connection to a range of strength (for example, 100 to 500 N) in which the connection can be separated.

In the above-mentioned first embodiment, the terminal connection part 21 is provided with the engaging walls 22 on both the side sections thereof and is formed into a reversed U-shape in a cross-sectional view, and the engaging pieces 22*a* being curved inward into a circular arc shape and folded back are formed at the lower end sections of the engaging walls 22. However, the cross-sectional shape of the terminal connection part 21 is not limited to the shape described above.

Second Embodiment

Next, the connection structure of a terminal fitting according to a second embodiment of the present invention will be described.

Since the components other than the terminal connection parts of the terminal fitting are almost the same in structure as those according to the first embodiment, they are designated by the same reference numerals and signs, and their descriptions are omitted.

Figure 9A:
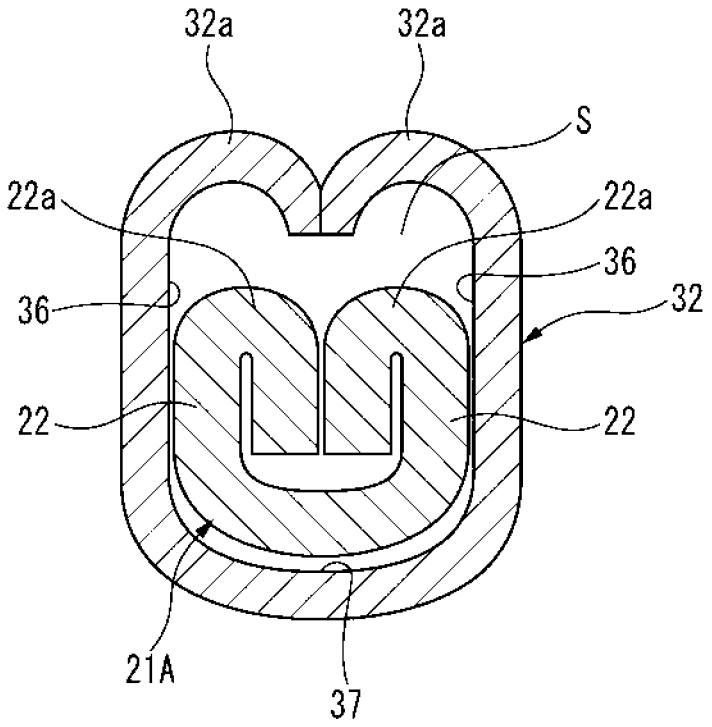
FIGS. 9A and 9B are views showing states in which the caulking pieces of a fastening connection section are fastened to the terminal connection part of a terminal fitting according to a second embodiment of the present invention.
Figure 9B:
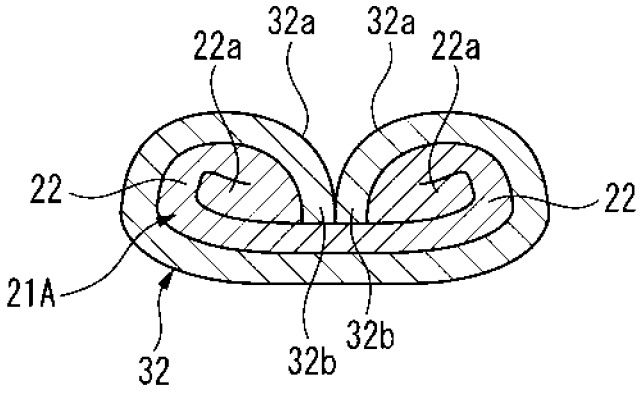

FIGS. 9A and 9B are views showing states in which the caulking pieces 32*a* of the fastening connection section 32 are fastened to the terminal connection part 21A of the terminal fitting according to the second embodiment of the present invention; FIG. 9A is a cross-sectional view before the fastening of the caulking pieces 32*a*, and FIG. 9B is a cross-sectional view after the fastening of the caulking pieces 32*a*.

As shown in FIG. 9A, the terminal connection part 21A of the terminal fitting 10 according to the second embodiment has the engaging walls 22 protruding to the upper face side on both the side sections thereof. Hence, the terminal connection part 21A is formed into a U-shape in a front view. Furthermore, the engaging walls 22 have the engaging pieces 22*a* being curved inward into a circular arc shape and folded back at the upper end sections thereof.

When the terminal connection part 21A is inserted into the holding space S of the fastening connection section 32, the terminal connection part 21A is inserted into the holding space S such that the ends portions of the pair of engaging walls 22 are directed to the same side of the ends portions 32*b* of the pair of caulking pieces 32*a*.

Furthermore, the caulking pieces 32*a* enfold both the side sections of the terminal connection part 21A. After that, the caulking pieces 32*a* enfold the engaging walls 22 and the engaging pieces 22*a* provided at the upper ends thereof from the outside, and the ends portions 32*b* are caulked so as to be folded back inward and make contact with each other.

As a result, as shown in FIG. 9B, the engaging walls 22 having the engaging pieces 22*a* are rounded and accommodated inside the caulking pieces 32*a* without clearance, and the inside of the fastening connection section 32 is in a state of being filled with the terminal connection part 21A. The fastening connection section 32 is thus strongly fastened to the terminal connection part 21A with high contact pressure, and the terminal fitting 10 is securely conducted to the connection terminal 30.

Since the ends portions 32*b* of the pair of caulking pieces 32*a* are caulked so as to be folded back inward and make contact with each other, residual stress in the direction in which the ends portions 32*b* make contact with each other is exerted, whereby the crimping section is suppressed from being opened and the connection strength can be enhanced.

The connection terminals 30 are then fastened to the respective terminal connection parts 21A of the terminal fitting 10 as described above. As a result, the plurality of grounding wires D is collectively conducted to the terminal fitting 10. The terminal fitting 10 is then fixed to the grounding face of the vehicle with the bolt, whereby the plurality of grounding wires D is grounded.

As described above, also in the case of the second embodiment, the terminal connection part 21A is held in the connection terminal 30 by inserting the terminal connection part 21A into the holding space S enclosed with the caulking pieces 32*a* of the connection terminal 30, whereby the caulking pieces 32*a* can be caulked and fastened in a state in which the terminal connection part 21A is held in the connection terminal 30. Hence, the terminal connection part 21A can be maintained in a stable posture during the caulking and fastening, whereby high connection reliability can be obtained while fluctuations in crimping strength are suppressed.

Furthermore, since the fastening work can be performed in a state in which the posture of the terminal connection part 21A with respect to the connection terminal 30 is maintained stable, the workability of the fastening work can be improved, and high connection reliability can be obtained while fluctuations in crimping strength are suppressed. Furthermore, since the holding space S is preliminarily formed in the connection terminal 30, the width of the connection terminal 30 can be suppressed in comparison with the width of a connection terminal in which the caulking pieces thereof are formed into a U-shape expanding upward. Hence, components, such as the crimper 43, to be used when the crimping machine 41 performs fastening can be downsized and the working space can be reduced.

Moreover, also in the case of the connection structure of the terminal fitting according to the second embodiment, the connection terminal 30 connected to the grounding wire D is caulked and fastened to the terminal connection part 21A of the terminal fitting 10, whereby the plurality of grounding wires D can be collectively conducted and connected to the terminal fitting 10 securely at high connection reliability.

Besides, as in the case of the first embodiment described above, the connection terminals 30 are caulked and fastened to the terminal fitting 10 by caulking the caulking pieces 32*a* of the connection terminals 30 connected to the plurality of grounding wires D to the plurality of terminal connection part 21A provided on the terminal fitting 10, whereby the plurality of the grounding wires D can be collectively conducted and connected to the terminal fitting 10. Hence, the terminal fitting 10 is not required to be stacked in comparison with the conventional structure in which the terminal fittings connected to the respective electric wires are stacked, fastened and conducted, whereby, even if the number of the electric wires increases, the increase in the weight of the terminal fitting can be suppressed. Furthermore, since the terminal fitting is not required to be stacked, even if the number of the electric wires to be conducted increases, the thickness of the terminal fitting does not increase, whereby space saving is attained. Moreover, since the connection terminals 30 are caulked and fastened to the terminal connection parts 21A of the terminal fitting 10, the need for special holding mechanisms for holding the connection terminals 30 can be eliminated. Consequently, the terminal fitting can be made small in size and low in cost in comparison with the joint connector that requires the holding mechanisms for holding terminals inside the housing thereof.

In addition, since the structure of the terminal fitting 10 is configured such that the connection terminals 30 separated from the terminal fitting 10 are fastened and connected to the terminal fitting 10, the connection terminals 30 to which the grounding wires D having different sizes are connected can be fastened and conducted to the terminal connection parts 21A. In other words, the grounding wires D having various sizes can be connected without changing the connection configuration between the terminal connection part 21A of the terminal fitting 10 and the fastening connection section 32 of the connection terminal 30. Furthermore, the increase/decrease in the number of the grounding wires D can be easily dealt with by preparing the terminal fittings 10 being different in the number of the terminal connection parts 21A.

In other words, also in the case of the connection structure of the terminal fitting according to the second embodiment, the terminal fitting 10 having minimum necessary variation can be used to deal with changes in the number and size of the grounding wire D to be conducted.

In addition, since the structure of the terminal fitting 10 is configured such that the connection terminals 30 are caulked and fastened to the plurality of terminal connection parts 21A of the terminal fitting 10, the connection terminals 30 can be fastened to the terminal connection parts 21A as necessary, whereby the number of the grounding wires D to be conducted collectively can be increased/decreased easily within the range of the number of the terminal connection parts 21A.

Furthermore, the engaging walls 22 to be engaged with the caulking pieces 32*a* are formed at both the side sections of the terminal connection part 21A. Hence, the caulking pieces 32*a* of the connection terminal 30 are engaged with the engaging walls 22 of the terminal connection part 21A by caulking the caulking pieces 32*a* to the terminal connection part 21A. As a result, the caulking pieces 32*a* can be securely crimped to the terminal connection part 21A, whereby the strength of the connection from the connection terminal 30 to the terminal connection part 21A can be enhanced further, and the electrical resistance at the connection position can be made stable and the electrical connection can be performed satisfactorily.

Furthermore, since the ends portions 32*b* of the pair of caulking pieces 32*a* are caulked so as to be folded back inward and make contact with each other, residual stress in the direction in which the ends portions 32*b* make contact with each other is exerted, whereby the crimping section is suppressed from being opened and the connection strength can be enhanced, and the reliability of the connection from the connection terminal 30 to the terminal connection part 21A is improved.

Third Embodiment

Next, a connection structure of a terminal fitting according to a third embodiment of the present invention will be described.

Since the components other than the terminal fitting are almost the same in structure as those according to the first embodiment, they are designated by the same reference numerals and signs, and their descriptions are omitted.

Figure 10A:
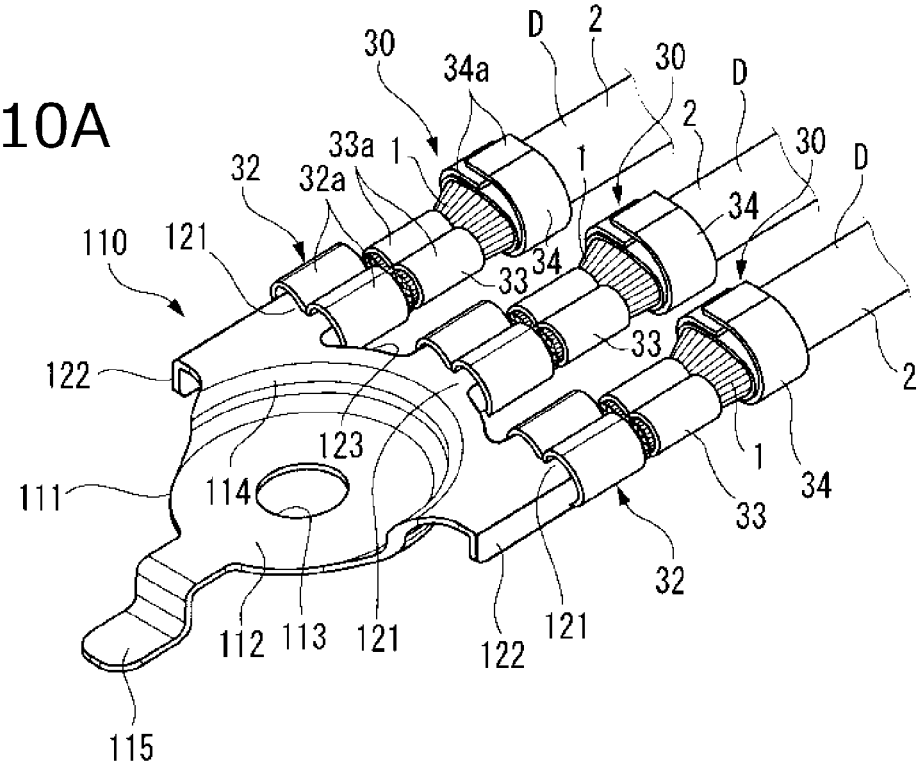
FIGS. 10A and 10B are views illustrating a connection structure of a terminal fitting according to a third embodiment of the present invention.
Figure 10B:
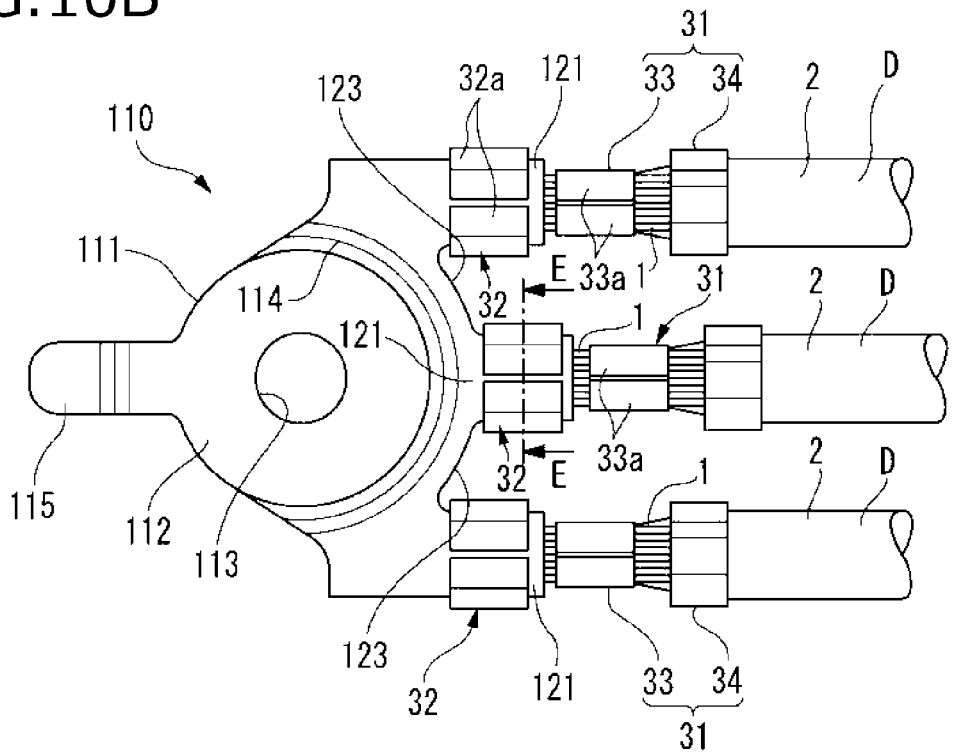
Figure 11A:
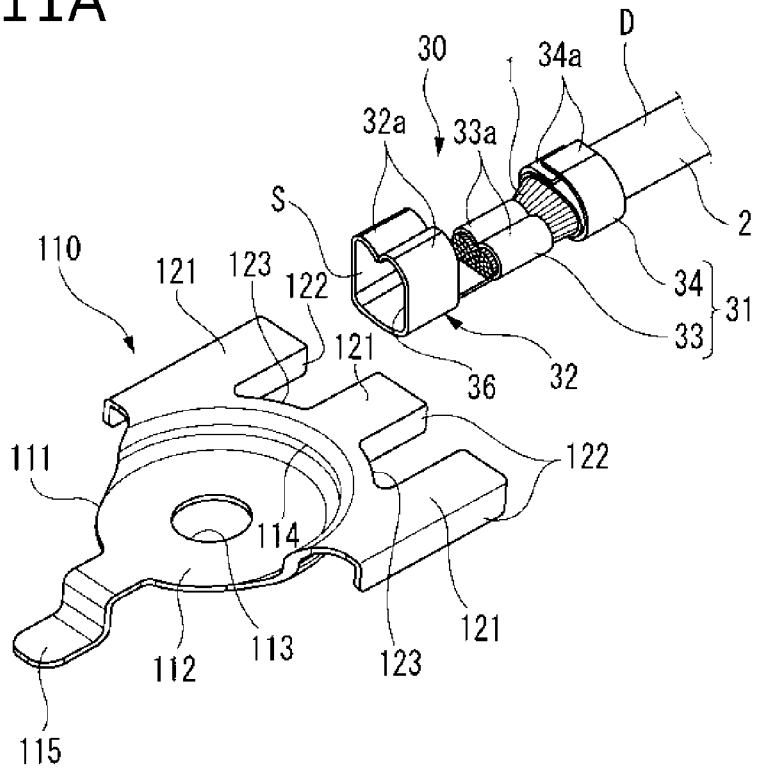
FIGS. 11A and 11B are views illustrating the connection structure of the terminal fitting according to the third embodiment.
Figure 11B:
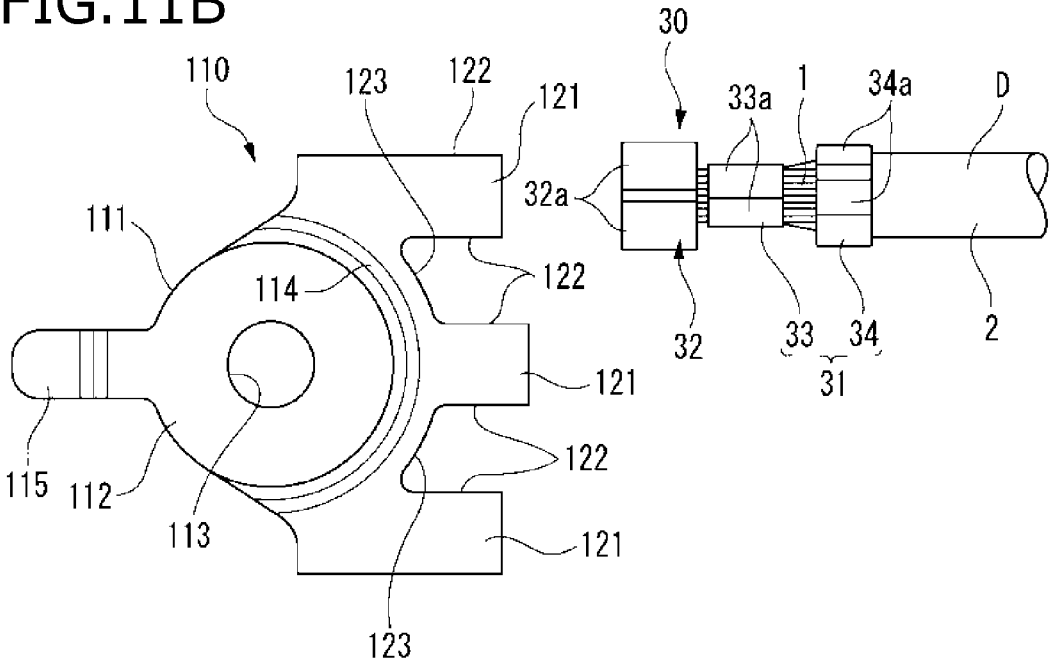

FIGS. 10A and 10B are views illustrating the connection structure of the terminal fitting according to the third embodiment; FIG. 10A is a perspective view showing a terminal fitting 110 to which the grounding wires D are connected, and FIG. 10B is a plan view showing the terminal fitting to which the grounding wires D are connected. FIGS. 11A and 11B are views showing the connection structure of the terminal fitting according to the third embodiment; FIG. 11A is a perspective view showing the terminal fitting and the connection terminal, and FIG. 11B is a plan view showing the terminal fitting and the connection terminal.

As shown in FIGS. 10A and 10B and FIGS. 11A and 11B, in the connection structure of the terminal fitting according to the third embodiment, the terminal fitting 110 is connected to the connection terminals 30. The terminal fitting 110 is also conducted and connected to the grounding face, such as a vehicle body. Hence, the grounding wires D of the vehicle-mounted circuits are conducted to the grounding face, such as a vehicle body, via the terminal fitting 110. The grounding wire D having a size of 8 $mm^2$, for example, is connected to the connection terminal 30.

Figure 12A:
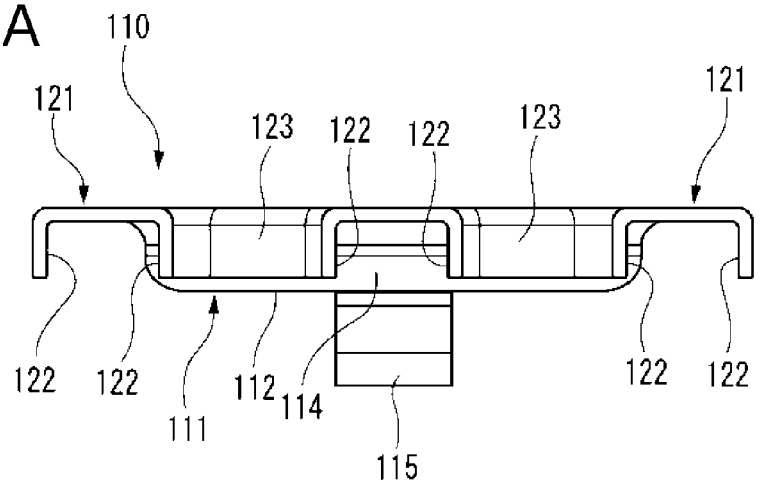
FIGS. 12A to 12C are views illustrating the terminal fitting shown in FIGS. 11A and 11B.
Figure 12B:
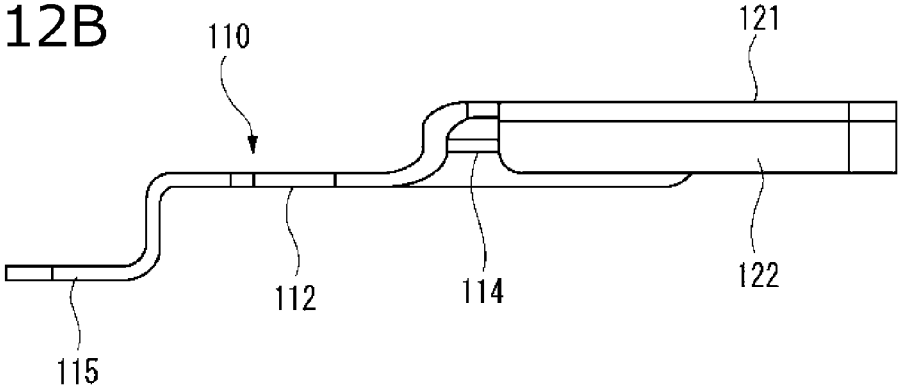
Figure 12C:
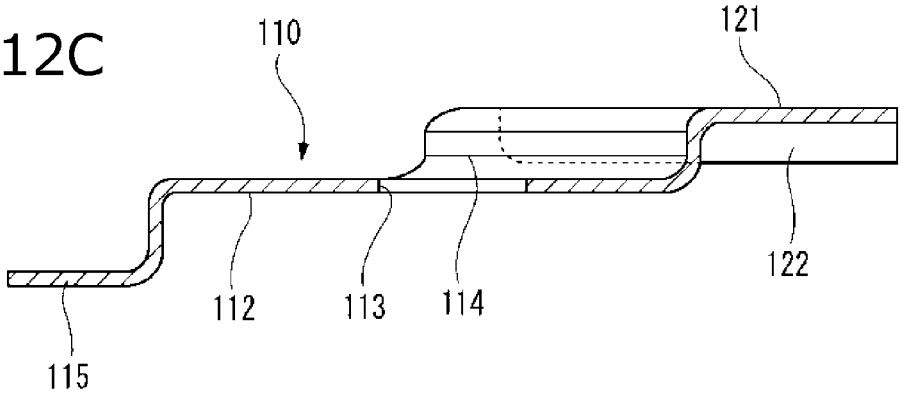
Figure 13A:
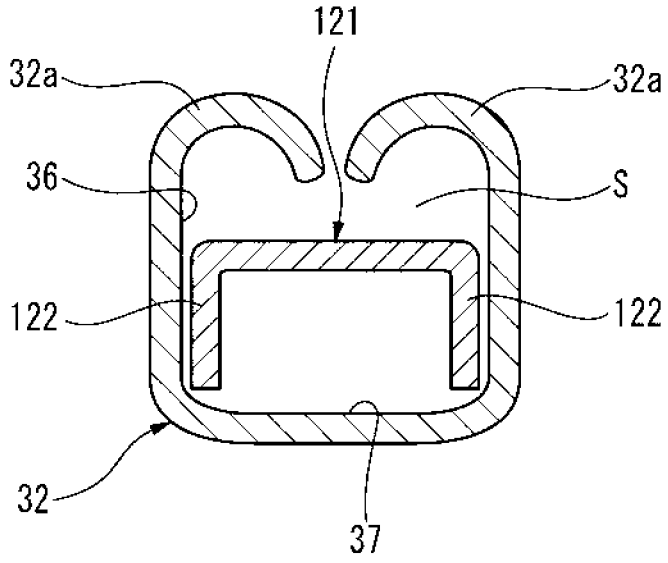
FIGS. 13A to 13C are views showing states in which the caulking pieces of the fastening connection section are fastened to the terminal connection part of the terminal fitting.
Figure 13B:
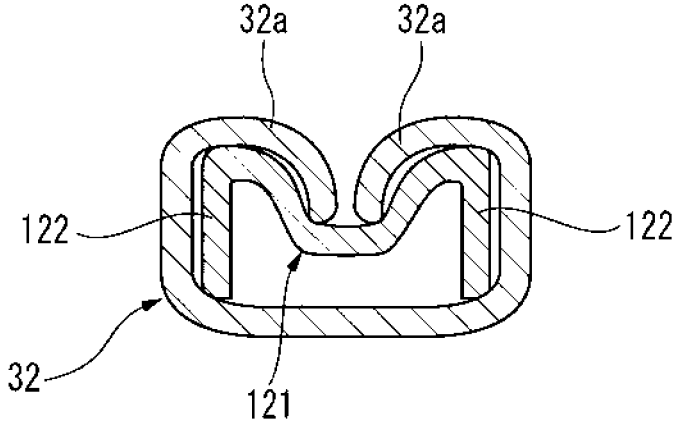
Figure 13C:
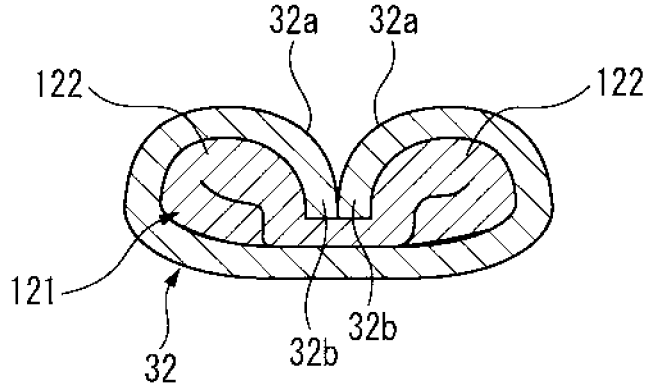

FIGS. 12A to 12C are views illustrating the terminal fitting; FIG. 12A is a front view, FIG. 12B is a side view, and FIG. 12C is a cross-sectional view. FIGS. 13A to 13C are views showing states in which the caulking pieces of the fastening connection section are fastened to the terminal connection part of the terminal fitting; FIG. 13A is a cross-sectional view taken on line E-E in FIG. 10B before the fastening of the caulking pieces, FIG. 13B is a cross-sectional view taken on line E-E in FIG. 10B during the fastening of the caulking pieces, and FIG. 13C is a cross-sectional view taken on line E-E in FIG. 10B after the fastening of the caulking pieces.

As shown in FIGS. 12A to 12C, the terminal fitting 110 has a terminal body 111 and terminal connection parts 121. The terminal fitting 110 is a press-formed product made of a metal plate having conductivity. The terminal body 111 has a fixing plate section 112 having a circular shape in a plan view. A circular mounting hole 113 is formed at the center of this fixing plate section 112. The terminal body 111 is fixed to the grounding face, such as a vehicle body, with a bolt (not shown) that is inserted into the mounting hole 113 of the fixing plate section 112. The mounting hole 113, however, is not required to be provided at the center of the fixing plate section 112, but may be provided eccentrically.

A connection plate section 114 is formed at a nearly half circumferential portion of the peripheral edge of the fixing plate section 112. The connection plate section 114 extends to the upper face side, that is, one of the face sides, of the fixing plate section 112. Hence, a step is formed between the fixing plate section 112 and the connection plate section 114. In addition, a rotation-stopping piece 115 is formed at the circumferentially central position of the portion of the fixing plate section 112 other than the connection plate section 114. The rotation-stopping piece 115 is a bent section to be engaged with a step or a hole provided around the grounding face to which the terminal body 111 is fastened with the bolt. The rotation of the terminal fitting 110 with respect to the grounding face is regulated by the engagement of the rotation-stopping piece 115 with the step or the hole provided around the grounding face.

The terminal connection parts 121 are integrated with the connection plate section 114 of the terminal body 111. The terminal connection parts 121 being plural in number are provided on the connection plate section 14. More specifically, the terminal connection parts 121 being three in number are formed on the connection plate section 114. These terminal connection parts 121 are respectively extended in the same plane from the peripheral edge of the fixing plate section 112 in the lead-out direction of the grounding wires D connected to the connection terminals 30 and are arranged at intervals in the width direction thereof. The terminal connection part 121 provided on the central side protrudes in the extension direction more than the terminal connection parts 121 provided on both the sides.

Each terminal connection part 121 has engaging walls 122 serving as caulked pieces and protruding to the lower face side, that is, one of the face sides, of the terminal connection part 121 on both the side sections thereof. Hence, each terminal connection part 121 is formed into a reversed U-shape in a front view. The engaging walls 122 of the terminal connection part 121, adjacent to each other, are formed continuously along the peripheral wall section 123 formed on the side of the fixing plate section 112.

For the connection of the grounding wire D to the above-mentioned terminal fitting 110, first, the outer coating 2 is removed to expose the conductor section 1 at the end section of the grounding wire D. The end section of the grounding wire D is then placed on the wire connection section 31 of the connection terminal 30, the conductor caulking section 33 is caulked, and the coating caulking section 34 is also caulked. As a result, the grounding wire D is connected to the connection terminal 30.

Next, the terminal connection part 121 of the terminal fitting 110 is inserted into the holding space S of the fastening connection section 32 of the connection terminal 30 connected to the grounding wire D so as to be temporarily fixed, and then the caulking pieces 32*a* are caulked. At this time, the terminal connection part 121 is inserted into the holding space S such that the ends portions of the pair of engaging walls 122 are directed to the opposite side of the ends portions of the pair of caulking pieces 32*a*.

When the caulking pieces 32*a* are caulked in a state in which the terminal connection part 121 of the terminal fitting 110 is disposed inside the holding space S of the fastening connection section 32 of the connection terminal 30 as shown in FIG. 13A, at the start time of the caulking, the caulking pieces 32*a* enfold the outsides of the pair of engaging walls 122 formed on the terminal connection part 121 of the terminal body 111 from the sides of the ends portions (the lower sides) thereof as shown in FIG. 13B.

After that, as shown in FIG. 13C, the caulking pieces 32*a* are caulked so as to enfold the outsides of the engaging walls 122 of the terminal connection part 121 from the sides of the ends portions thereof. As a result, the pair of engaging walls 122 is rounded and accommodated inside the caulking pieces 32*a* without clearance, and the inside of and the inside of the fastening connection section 32 is in a state of being filled with the terminal connection part 121. Furthermore, also at this time, the terminal connection part 121 is maintained in the predetermined posture with respect to the connection terminal 30 inside the holding space S. Consequently, the fastening connection section 32 is strongly fastened to the terminal connection part 121 with high contact pressure, and the terminal fitting 110 is crimped to the connection terminal 30 in good balance and connected thereto securely.

Since the pair of caulking pieces 32*a* is caulked so as to enfold the outsides of the pair of engaging walls 122 from the sides of the ends portions thereof, the strength of the connection can be enhanced while residual stress in the opening direction of the crimping section is lowered. That is to say, since the ends portions of the engaging walls 122 are positioned on the bottom section side of the fastening connection section 32, the residual stress in the opening direction of the engaging walls 122 is applied to the base section sides of the caulking pieces 32*a* but is hardly applied to the opening end sides of the caulking pieces 32*a*. As a result, in comparison with a crimping section that is caulked such that the ends portions of the engaging walls are positioned on the sides of the ends portions of the fastening connection section, in the case of the crimping section in the connection structure of the terminal fitting according to the third embodiment, the residual stress in the opening direction lowers and the strength of the connection is enhanced, whereby the reliability of the connection from the connection terminal 30 to the terminal connection part 121 is improved.

Furthermore, since the ends portions 32*b* of the pair of caulking pieces 32*a* are caulked so as to be folded back inward and make contact with each other, residual stress in the direction in which the ends portions 32*b* make contact with each other is exerted, whereby the crimping section is suppressed from being opened and the connection strength can be enhanced further.

The respective terminal connection parts 121 of the terminal fitting 110 are fastened to the connection terminals 30 as described above. Hence, the plurality of grounding wires D is collectively conducted to the terminal fitting 110. The terminal fitting 110 is then fixed to the grounding face of the vehicle with the bolt, whereby the plurality of grounding wires D is grounded.

As described above, also in the case of the third embodiment, the terminal connection part 121 is held in the connection terminal 30 by inserting the terminal connection part 121 into the holding space S enclosed with the caulking pieces 32*a* of the connection terminal 30, whereby the caulking pieces 32*a* can be caulked and fastened in a state in which the terminal connection part 121 is held in the connection terminal 30. Hence, the terminal connection part 121 can be maintained in a stable posture during the caulking and fastening, whereby high connection reliability can be obtained while fluctuations in crimping strength are suppressed.

Moreover, since the fastening work can be performed in a state in which the posture of the terminal connection part 121 with respect to the connection terminal 30 is maintained stable, the workability of the fastening work can be improved, and high connection reliability can be obtained while fluctuations in crimping strength are suppressed. Also, since the holding space S is preliminarily formed in the connection terminal 30, the width of the connection terminal 30 can be suppressed in comparison with the width of a connection terminal in which the caulking pieces 32*a* thereof are formed into a U-shape expanding upward. Hence, components, such as the crimper 43, to be used when the crimping machine 41 performs fastening can be downsized and the working space can be reduced.

Besides, also in the case of the connection structure of the terminal fitting according to the third embodiment, since the connection terminal 30 connected to the grounding wire D is caulked and fastened to the terminal connection part 121 of the terminal fitting 110, the plurality of grounding wires D can be collectively conducted and connected to the terminal fitting 110 securely at high connection reliability.

Besides, as in the case of the first embodiment described above, the connection terminals 30 are caulked and fastened to the terminal fitting 110 by caulking the caulking pieces 32*a* of the connection terminals 30 connected to the plurality of grounding wires D to the plurality of terminal connection part 121 provided on the terminal fitting 110, whereby the plurality of the grounding wires D can be collectively conducted and connected to the terminal fitting 110. Hence, the terminal fitting 110 is not required to be stacked in comparison with the conventional structure in which the terminal fittings connected to the respective electric wires are stacked, fastened and conducted, whereby, even if the number of the electric wires increases, the increase in the weight of the terminal fitting can be suppressed. Furthermore, since the terminal fitting is not required to be stacked, even if the number of the electric wires to be conducted increases, the thickness of the terminal fitting does not increase, whereby space saving is attained. Moreover, since the connection terminals 30 are caulked and fastened to the terminal connection parts 121 of the terminal fitting 110, the need for special holding mechanisms for holding the connection terminals 30 can be eliminated. Consequently, the terminal fitting can be made small in size and low in cost in comparison with the joint connector that requires the holding mechanisms for holding terminals inside the housing thereof.

In addition, since the structure of the terminal fitting 110 is configured such that the connection terminals 30 separated from the terminal fitting 110 are fastened and connected to the terminal fitting 110, the connection terminals 30 to which the grounding wires D having different sizes are connected can be fastened and conducted to the terminal connection parts 121. In other words, the grounding wires D having various sizes can be connected without changing the connection configuration between the terminal connection part 121 of the terminal fitting 110 and the fastening connection section 32 of the connection terminal 30. Furthermore, the increase/decrease in the number of the grounding wires D can be easily dealt with by preparing the terminal fittings 110 being different in the number of the terminal connection parts 121.

That is to say, also in the case of the connection structure of the terminal fitting according to the third embodiment, the terminal fitting 110 having minimum necessary variation can be used to deal with changes in the number and size of the grounding wire D to be conducted.

In addition, since the structure of the terminal fitting 110 is configured such that the connection terminals 30 are caulked and fastened to the plurality of terminal connection parts 121 of the terminal fitting 110, the connection terminals 30 can be fastened to the terminal connection parts 121 as necessary, whereby the number of the grounding wires D to be conducted collectively can be increased/decreased easily within the range of the number of the terminal connection parts 121.

Furthermore, the engaging walls 122 to be engaged with the caulking pieces 32*a* are formed at both the side sections of the terminal connection part 121. Hence, the caulking pieces 32*a* of the connection terminal 30 are engaged with the engaging walls 122 of the terminal connection part 121 by caulking the caulking pieces 32*a* to the terminal connection part 121. As a result, the caulking pieces 32*a* can be securely crimped to the terminal connection part 121, whereby the strength of the connection from the connection terminal 30 to the terminal connection part 121 can be enhanced further, and the electrical resistance at the connection position can be made stable and the electrical connection can be performed satisfactorily.

Moreover, since the pair of caulking pieces 32*a* is caulked so as to enfold the outsides of the pair of engaging walls 122 from the sides of the ends portions thereof, the strength of the connection can be enhanced while residual stress in the opening direction of the crimping section is lowered, whereby the reliability of the connection from the connection terminal 30 to the terminal connection part 121 is improved.

Additionally, the terminal connection parts 121 according to the third embodiment are respectively extended in the same plane in the lead-out direction of the grounding wires D connected to the connection terminals 30 while being arranged mutually at intervals. Hence, the connection directions of the terminals 30 with respect to the terminal fitting 110 and the wiring directions of the grounding wires D can be aligned to the same direction, whereby the workability of the fastening of the connection terminals 30 to the terminal connection parts 121 of the terminal fitting 110 can be improved. Besides, the wiring directions of the grounding wires D can be aligned to the same direction along the flow of the trunk line, and unnecessary spreading of the grounding wires D and bending of the grounding wires D in the vicinity of the connection terminals 30 can be suppressed as much as possible.

In addition, also in the terminal connection part 121 of the terminal fitting 110 according to the third embodiment, the engaging pieces of the engaging walls 122 may be formed at the lower ends thereof and may be formed into a V-shape in cross section.

Furthermore, although the above-mentioned terminal fitting 110 having the three terminal connection parts 121 has been taken as an example and described, the number of the terminal connection parts 121 of the terminal fitting 110 may be plural; the number is not limited to three but may be four or more.

Moreover, in the above-mentioned first to third embodiments, the grounding wires D of the vehicle-mounted circuits (auxiliary devices) are connected to the terminal fitting 10, 110, whereby the grounding wires D are collectively grounded. However, electric wires to be connected to the terminal fitting 10, 110 are not limited to grounding wires.

Besides, instead of providing the rotation-stopping piece 15, 115 on the terminal body 11, 111 of the terminal fitting 10, 110, a step or a rotation-stopping piece that makes contact with the terminal fitting 10, 110 to stop the rotation thereof when the terminal fitting 10, 110 is mounted on a grounding face may be provided on the side of the grounding face.

However, the present invention is not limited to the above-mentioned embodiments, but can be modified or improved as necessary. In addition, the materials, shapes, dimensions, quantities, arrangement positions, etc. of the respective components in the above-mentioned embodiments may be arbitrary and not limited, provided that the present invention can be achieved.

The characteristics of the embodiments of the connection structure and the connection method of the terminal fitting according to the present invention described above will be briefly summarized and listed in the following items [1] to [4].

[1] A connection structure of a terminal fitting including:
- a terminal fitting (10, 110) having:
- a terminal body (11, 111); and
- a plurality of terminal connection parts (21, 121, 21A) extended from the terminal body; and connection terminals (30) each having a pair of caulking pieces (32*a*), and each of the connection terminals configured to be connected to an end part of an electric wire (D), wherein in each of the plurality of terminal connection parts of the terminal fitting, the connection terminal is caulked to the terminal connection part so that the pair of caulking pieces of the connection terminal enfold outsides of a pair of caulked pieces (engaging walls 22, 122) provided on the terminal connection part in a state that a bottom face between the pair of caulking pieces faces an opening between ends portions of the pair of caulked pieces: or the connection terminal is caulked to the terminal connection part so that the pair of caulking pieces of the connection terminal enfold outsides of both side sections of the terminal connection part and end portions (32*b*) of the pair of caulking pieces are folded back inward and made contact with each other; and wherein the terminal fitting is connected to the electric wires through the connection terminals.

[2] In the connection structure of the terminal fitting, wherein the terminal connection parts are extended radially in the same plane.

[3] In the connection structure of the terminal fitting, the terminal connection parts are extended in the same plane and are extended at intervals in lead-out directions of the electric wires connected to the connection terminals.

[4] A connection method of a terminal fitting (10, 110) having a terminal body (11, 111) and a plurality of terminal connection parts (21, 121) extended from the terminal body, for performing connection by caulking a pair of caulking pieces (32*a*) of a connection terminal (30) connected to an end part of an electric wire (D) to a pair of caulked pieces (22, 122) provided on the terminal connection part, in each of the plurality of terminal connection parts of the terminal fitting, the connection method comprising:

forming a holding space (S) into which the pair of caulked pieces of the terminal connection part can be inserted in the connection terminal by the caulking pieces;

holding the terminal connection part in the connection terminal by inserting the terminal connection part into the holding space so that end portions of the pair of caulked pieces are directed in an opposite direction with respect to end portions of the pair of caulking pieces; and caulking the pair of caulked pieces in the holding space by crushing the pair of caulking pieces.

With the connection structure of the terminal fitting configured as described in the above-mentioned items [1] to [3], the connection terminals are fastened to the terminal fitting by caulking the caulking pieces of the connection terminals connected to the end sections of a plurality of electric wires to the plurality of terminal connection parts provided on the terminal fitting, whereby the plurality of the electric wires can be collectively conducted and connected to the terminal fitting. Hence, the terminal fitting is not required to be stacked in comparison with a structure in which terminal fittings connected to respective electric wires are stacked, fastened and conducted, whereby, even if the number of the electric wires increases, the increase in the weight of the terminal fitting can be suppressed. Furthermore, since the terminal fitting is not required to be stacked, even if the number of the electric wires to be conducted and connected increases, the thickness of the terminal fitting does not increase, whereby space saving is attained.

Moreover, since the connection terminals are caulked and fastened to the terminal connection parts of the terminal fitting, the need for special holding mechanisms for holding the connection terminals can be eliminated. Consequently, the terminal fitting can be made small in size and low in cost in comparison with a joint connector that requires holding mechanisms for holding terminals inside the housing thereof.

In addition, since the structure of the terminal fitting is configured such that the connection terminals separated from the terminal fitting are caulked, fastened and connected to the terminal fitting, the connection terminals to which the electric wires having different sizes are connected can be caulked, fastened and conducted to the terminal connection parts. In other words, the electric wires having various sizes can be connected without changing the connection configuration between the terminal connection part of the terminal fitting and the fastening connection section of the connection terminal. Furthermore, the increase/decrease in the number of the electric wires to be conducted can be easily dealt with by preparing the terminal fittings being different in the number of the terminal connection parts. As a result, the terminal fitting having minimum necessary variation can be used to deal with the changes in the number and size of the electric wires to be conducted.

Moreover, since the structure of the terminal fitting is configured such that the connection terminals are caulked and fastened to the plurality of terminal connection parts of the terminal fitting, the connection terminals can be caulked and fastened to the terminal connection parts as necessary, whereby the number of the electric wires to be conducted collectively can be increased/decreased easily within the range of the number of the terminal connection parts.

Still further, since the pair of caulking pieces is caulked so as to enfold the outsides of the pair of caulked pieces from the sides of the ends portions thereof, the strength of the connection can be enhanced while residual stress in the opening direction of the crimping section is lowered, whereby the reliability of the connection from the connection terminal to the terminal connection part is improved.

With the connection structure of the terminal fitting configured as described above, the connection terminals are fastened to the terminal fitting by caulking the caulking pieces of the connection terminals connected to the end sections of a plurality of electric wires to the plurality of terminal connection parts provided on the terminal fitting, whereby the plurality of the electric wires can be collectively conducted and connected to the terminal fitting. Hence, the terminal fitting is not required to be stacked in comparison with a structure in which terminal fittings connected to respective electric wires are stacked, fastened and conducted, whereby, even if the number of the electric wires increases, the increase in the weight of the terminal fitting can be suppressed. Furthermore, since the terminal fitting is not required to be stacked, even if the number of the electric wires to be conducted and connected increases, the thickness of the terminal fitting does not increase and space saving is attained.

Moreover, since the connection terminals are caulked and fastened to the terminal connection parts of the terminal fitting, the need for special holding mechanisms for holding the connection terminals can be eliminated. Consequently, the terminal fitting can be made small in size and low in cost in comparison with a joint connector that requires holding mechanisms for holding terminals inside the housing thereof.

In addition, since the structure of the terminal fitting is configured such that the connection terminals separated from the terminal fitting are caulked, fastened and connected to the terminal fitting, the connection terminals to which the electric wires having different sizes are connected can be caulked, fastened and conducted to the terminal connection parts. In other words, the electric wire having various sizes can be connected without changing the connection configuration between the terminal connection part of the terminal fitting and the fastening connection section of the connection terminal. Furthermore, the increase/decrease in the number of the electric wires to be conducted can be easily dealt with by preparing the terminal fittings being different in the number of the terminal connection parts. As a result, the terminal fitting having minimum necessary variation can be used to deal with the changes in the number and size of the electric wires to be conducted.

Moreover, since the structure of the terminal fitting is configured such that the connection terminals are fastened to the plurality of terminal connection parts of the terminal fitting, the connection terminals can be caulked and fastened to the terminal connection parts as necessary, whereby the number of the electric wires to be conducted collectively can be increased/decreased easily within the range of the number of the terminal connection parts.

Still further, since the pair of caulking pieces are caulked so as to enfold the outsides of both the side sections of the terminal connection part and so that the ends portions of the terminal connection part are folded back inward and made contact with each other, residual stress in the direction in which the ends portions make contact with each other is exerted, whereby the crimping section is suppressed from being opened, the connection strength can be enhanced, and the reliability of the connection from the connection terminal to the terminal connection part is improved.

With the connection structure of the terminal fitting configured as described above, the terminal connection parts are extended radially in the same plane, whereby numerous terminal connection parts can be provided while the occupancy area of the terminal fitting is suppressed as small as possible, whereby numerous electric wire wires can be connected collectively.

With the connection structure of the terminal fitting configured as described above, the connection directions of the connection terminals with respect to the terminal fitting can be aligned to the lead-out directions of the electric wires connected to the connection terminals, whereby the workability of the fastening of the connection terminals to the terminal connection parts of the terminal fitting can be improved. Besides, the wiring directions of the electric wires can be aligned to the same direction along the flow of the trunk line, and unnecessary spreading of the electric wires and bending of the electric wires in the vicinity of the connection terminals can be suppressed as much as possible.

With the connection method as described in the above-mentioned item [4], the terminal connection part is inserted and held in the holding space preliminarily formed in the connection terminal, and the caulking pieces are crushed, caulked and fastened so as to enfold the outsides of the pair of caulked pieces being formed on the terminal connection part in the holding space from the sides of the ends portions of the pair of caulked pieces, whereby the fastening work can be performed in a state in which the posture of the terminal connection part with respect to the connection terminal is maintained stable. Hence, the workability of the fastening work can be improved, and high connection reliability can be obtained while fluctuations in crimping strength are suppressed. Furthermore, since the holding space is preliminarily formed in the connection terminal, the width of the connection terminal can be suppressed in comparison with the width of a connection terminal in which the caulking pieces thereof are formed into a U-shape expanding upward. Hence, components, such as a crimper, to be used when a crimping machine performs fastening can be downsized and the working space can be reduced.

Moreover, since the pair of caulking pieces is caulked so as to enfold the outsides of the pair of caulked pieces from the sides of the ends portions thereof, the strength of the connection can be enhanced while residual stress in the opening direction of the crimping section is lowered, whereby the reliability of the connection from the connection terminal to the terminal connection part is improved.

What is claimed is:

1. A connection structure of a terminal fitting, comprising:

a terminal fitting comprising:

a terminal body; and a plurality of terminal connection parts extended from the terminal body; and connection terminals each having a pair of caulking pieces, and each of the connection terminals configured to be connected to an end part of an electric wire, wherein in each of the plurality of terminal connection parts of the terminal fitting, the connection terminal is caulked to the terminal connection part so that the pair of caulking pieces of the connection terminal enfold outsides of a pair of caulked pieces provided on the terminal connection part in a state that a bottom face between the pair of caulking pieces faces an opening between end portions of the pair of caulked pieces: or the connection terminal is caulked to the terminal connection part so that the pair of caulking pieces of the connection terminal enfold outsides of both side sections of the terminal connection part and end portions of the pair of caulking pieces are folded back inward and made contact with each other; and wherein the terminal fitting is connected to the electric wires through the connection terminals.

2. The connection structure of the terminal fitting according to claim 1, wherein the terminal connection parts are extended radially in the same plane.

3. The connection structure of the terminal fitting according to claim 1, wherein the terminal connection parts are extended in the same plane and are extended at intervals in lead-out directions of the electric wires connected to the connection terminals.

4. A connection method of a terminal fitting having a terminal body and a plurality of terminal connection parts extended from the terminal body, for performing connection by caulking a pair of caulking pieces of a connection terminal connected to an end part of an electric wire to a pair of caulked pieces provided on the terminal connection part, in each of the plurality of terminal connection parts of the terminal fitting, the connection method comprising:

forming a holding space into which the pair of caulked pieces of the terminal connection part can be inserted in the connection terminal by the caulking pieces;

holding the terminal connection part in the connection terminal by inserting the terminal connection part into the holding space so that end portions of the pair of caulked pieces are directed in an opposite direction with respect to end portions of the pair of caulking pieces; and caulking the pair of caulked pieces in the holding space by crushing the pair of caulking pieces.

* * * * *